US009141051B2

(12) United States Patent
Yoshinaga et al.

(10) Patent No.: US 9,141,051 B2
(45) Date of Patent: Sep. 22, 2015

(54) FIXING DEVICE AND IMAGE FORMING APPARATUS

(71) Applicants: Hiroshi Yoshinaga, Chiba (JP); Takayuki Seki, Kanagawa (JP); Yuji Arai, Kanagawa (JP); Ryuuichi Mimbu, Kanagawa (JP); Yutaka Ikebuchi, Kanagawa (JP); Yoshiki Yamaguchi, Kanagawa (JP); Shuntaro Tamaki, Kanagawa (JP); Kazuya Saito, Kanagawa (JP); Shuutaroh Yuasa, Kanagawa (JP); Toshihiko Shimokawa, Kanagawa (JP)

(72) Inventors: Hiroshi Yoshinaga, Chiba (JP); Takayuki Seki, Kanagawa (JP); Yuji Arai, Kanagawa (JP); Ryuuichi Mimbu, Kanagawa (JP); Yutaka Ikebuchi, Kanagawa (JP); Yoshiki Yamaguchi, Kanagawa (JP); Shuntaro Tamaki, Kanagawa (JP); Kazuya Saito, Kanagawa (JP); Shuutaroh Yuasa, Kanagawa (JP); Toshihiko Shimokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/190,048

(22) Filed: Feb. 25, 2014

(65) Prior Publication Data

US 2014/0248072 A1 Sep. 4, 2014

(30) Foreign Application Priority Data

Mar. 4, 2013 (JP) ..... 2013-042393

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
USPC ..... 399/329
See application file for complete search history.

(56) References Cited

U.S. PATENT DOCUMENTS

| | | | | |
|---|---|---|---|---|
| 7,428,401 | B2 | 9/2008 | Oonishi | |
| 7,437,110 | B2 | 10/2008 | Kondo et al. | |
| 7,869,753 | B2 | 1/2011 | Shinshi | |
| 8,010,028 | B2 | 8/2011 | Shinshi | |
| 8,086,159 | B2 | 12/2011 | Shinshi | |
| 8,428,499 | B2 | 4/2013 | Shinshi | |
| 2013/0195525 | A1* | 8/2013 | Yoshinaga et al. | 399/329 |
| 2014/0064804 | A1 | 3/2014 | Yamaguchi et al. | |
| 2014/0072355 | A1 | 3/2014 | Tamaki et al. | |
| 2014/0079453 | A1 | 3/2014 | Arai et al. | |

FOREIGN PATENT DOCUMENTS

| | | |
|---|---|---|
| JP | 2004-198969 | 7/2004 |
| JP | 2004-286922 | 10/2004 |
| JP | 2007-233011 | 9/2007 |
| JP | 2007-334205 | 12/2007 |
| JP | 2008-158482 | 7/2008 |

(Continued)

*Primary Examiner* — Clayton E Laballe
*Assistant Examiner* — Jas Sanghera
(74) *Attorney, Agent, or Firm* — Duft Bornsen & Fettig LLP

(57) ABSTRACT

A fixing device includes a support member disposed to support a nip formation member on an inner peripheral surface of a fixing belt. The support member includes a parallel portion that supports the nip formation member and extends parallel to a sheet transport direction in a nip portion, and a rise portion that extends from the parallel portion in a direction drawn apart from the nip portion. The rise portion is inclined to the parallel portion such that an inclination direction of the rise portion is substantially parallel to a virtual straight line connecting a center of rotation of the fixing belt and an inlet point of the nip portion or falls within a range of rotational angles of ±15° by which the virtual straight line is rotated around the center of rotation of the fixing belt.

10 Claims, 14 Drawing Sheets

(56) References Cited

FOREIGN PATENT DOCUMENTS

| | | |
|---|---|---|
| JP | 2008-216928 | 9/2008 |
| JP | 2009-003410 | 1/2009 |
| JP | 2010-079309 | 4/2010 |
| JP | 2012-108189 | 6/2012 |
| JP | 2012-113243 | 6/2012 |
| JP | 2012-145703 | 8/2012 |
| JP | 2013-178461 | 9/2013 |

* cited by examiner

FIXING DEVICE AND IMAGE FORMING APPARATUS

CROSS-REFERENCE TO RELATED APPLICATION

The present application is based upon and claims the benefit of priority of Japanese Patent Application No. 2013-042393, filed on Mar. 4, 2013, the contents of which are incorporated herein by reference in their entirety.

BACKGROUND OF THE INVENTION

1. Field of the Invention

The present invention relates to a fixing device for an image forming apparatus, such as a printer, a facsimile machine or a copier, and relates to an image forming apparatus including a fixing device.

2. Description of the Related Art

Fixing devices are used in various image forming apparatuses, such as copiers, printers, facsimile machines or multifunction peripherals. Among them, a fixing device including a thin-walled fixing belt which is implemented by a metallic base plate and an elastic layer is known. The thin-walled fixing belt provides a reduced thermal capacity and the energy required for heating the fixing belt may be substantially reduced. Further, with the thin-walled fixing belt, a warm-up time and a first print time of the fixing device may be shortened.

For example, Japanese Laid-Open Patent Publication No. 2007-233011 discloses a fixing device of this type. FIG. 16 shows a composition of a fixing device 120 according to the related art as disclosed in Japanese Laid-Open Patent Publication No. 2007-233011. As shown in FIG. 16, in this fixing device 120, a nip formation member 124 is disposed on an inner peripheral surface of an endless fixing belt 121, and a pressure roller 122 is made to contact the nip formation member 124 via the fixing belt 121. A nip portion N is formed between the fixing belt 121 and the pressure roller 122. When the pressure roller 122 is rotated by a drive unit which is not illustrated, the fixing belt 121 follows the rotation of the pressure roller 122 and is rotated.

The nip formation member 124 is supported on an inner peripheral surface of the fixing belt 121 by a support member 125 and both ends of the support member 125 in a longitudinal direction thereof are fixed to side plates of a body of an image forming apparatus. The support member 125 includes a parallel portion 125*a* and a rise portion 125*b*. The parallel portion 125*a* is parallel to a transport direction of a sheet P at the nip portion N and supports the nip formation member 124. The rise portion 125*b* vertically projects upward from the parallel portion 125*a* in a direction to go away from the nip portion N 124. The support member 125 serves to increase the rigidity of the nip formation member 124 against the pressing force of the pressure roller 122.

A heat source 123 which is a heating unit to heat the fixing belt 121 in a region fully covering a width of a sheet by radiant heat is disposed on an inner peripheral side of the fixing belt 121. The fixing belt 121 except the portion where the nip formation member 124 is disposed may be directly heated by the radiant heat from the heat source 123, and the efficiency of heat transfer from the heat source 123 to the fixing belt 121 may be substantially increased. Accordingly, the power consumption may be reduced and the first print time from the heating standby state may be shortened further.

In the above-described fixing device, the fixing belt is directly heated, and if the diameter of the fixing belt is reduced to a diameter of approximately 30 mm, the heat consumption region where heat dissipates from the fixing belt may be reduced and thermal efficiency may be increased.

Unlike a time of stopping the rotation of the fixing belt or during a stable rotation state, when the pressure roller is initially actuated to rotate the fixing belt at a start of operation of the fixing device, a dynamic load from the pressure roller is applied to the fixing belt in a direction from the end of the nip portion toward the center of rotation of the fixing belt. Hence, an oblique-direction force due to the dynamic load is exerted on the nip formation member in a direction oblique to the sheet transport direction in the nip portion so that bending or torsion of the nip formation member may take place. If the support member has sufficient rigidity, the occurrence of bending or torsion of the nip formation member at this time may be prevented.

However, if a small-sized fixing belt is used, the support member disposed on the inner peripheral surface of the fixing belt is usually small-sized. The rigidity of the parallel portion or the rise portion of the support member is reduced (or falls) depending on the composition of the support member in such a case, and it is difficult to obtain sufficient rigidity of the support member.

At a start of the rotation of the fixing belt, the oblique-direction force due to the dynamic load is exerted on the parallel portion of the support member through the nip formation member. At this time, the rise portion may support the parallel portion against the oblique-direction force, and the occurrence of bending or torsion in the parallel portion may be prevented more positively than in a case where the support member has no rise portion.

However, the rise portion projects vertically upward from the parallel portion, and the oblique-direction force due to the dynamic load is applied to the rise portion via the parallel portion in a direction to bend the rise portion. Hence, if the rigidity of the rise portion falls as described above, bending or torsion of the rise portion may take place and the effects to prevent the occurrence of bending or torsion of the parallel portion by the rise portion may be reduced. As a result, the occurrence of bending or torsion of the nip formation member which is supported by the parallel portion may not be prevented. In such a case, the pressure pattern of the nip portion may vary, the nip width may vary, and poor fixing may arise.

SUMMARY OF THE INVENTION

In one aspect, the present invention provides a fixing device which is capable of preventing the occurrence of bending or torsion of a nip formation member at a start of rotation of a fixing belt.

In one embodiment, the present invention provides a fixing device including a rotatably supported endless fixing belt; a pressure roller disposed to press an outer peripheral surface of the fixing belt and cause rotation of the fixing belt when the pressure roller is rotated; a nip formation member disposed on an inner peripheral surface of the fixing belt to form a nip portion in the fixing belt between the nip formation member and the pressure roller when the fixing belt is pressed by the pressure roller; a heating unit to heat the fixing belt; and a support member disposed to support the nip formation member on the inner peripheral surface of the fixing belt, wherein the support member comprises a parallel portion that supports the nip formation member and extends parallel to a sheet transport direction in the nip portion, and a rise portion that extends from the parallel portion in a direction drawn apart from the nip portion, and the rise portion is inclined to the parallel portion such that an inclination direction of the rise portion is substantially parallel to a virtual straight line connecting a center of rotation of the fixing belt and an inlet point of the nip portion or falls within a range of rotational angles of ±15° by which the virtual straight line is rotated around the center of rotation of the fixing belt.

Other objects, features and advantages of the present invention will become more apparent from the following detailed description when read in conjunction with the accompanying drawings.

DETAILED DESCRIPTION OF THE PREFERRED EMBODIMENTS

A description will be given of embodiments with reference to the accompanying drawings.

First, a composition of an image forming apparatus 1 in which a fixing device according to an embodiment is provided is explained with reference to FIG. 2.

Figure 2:
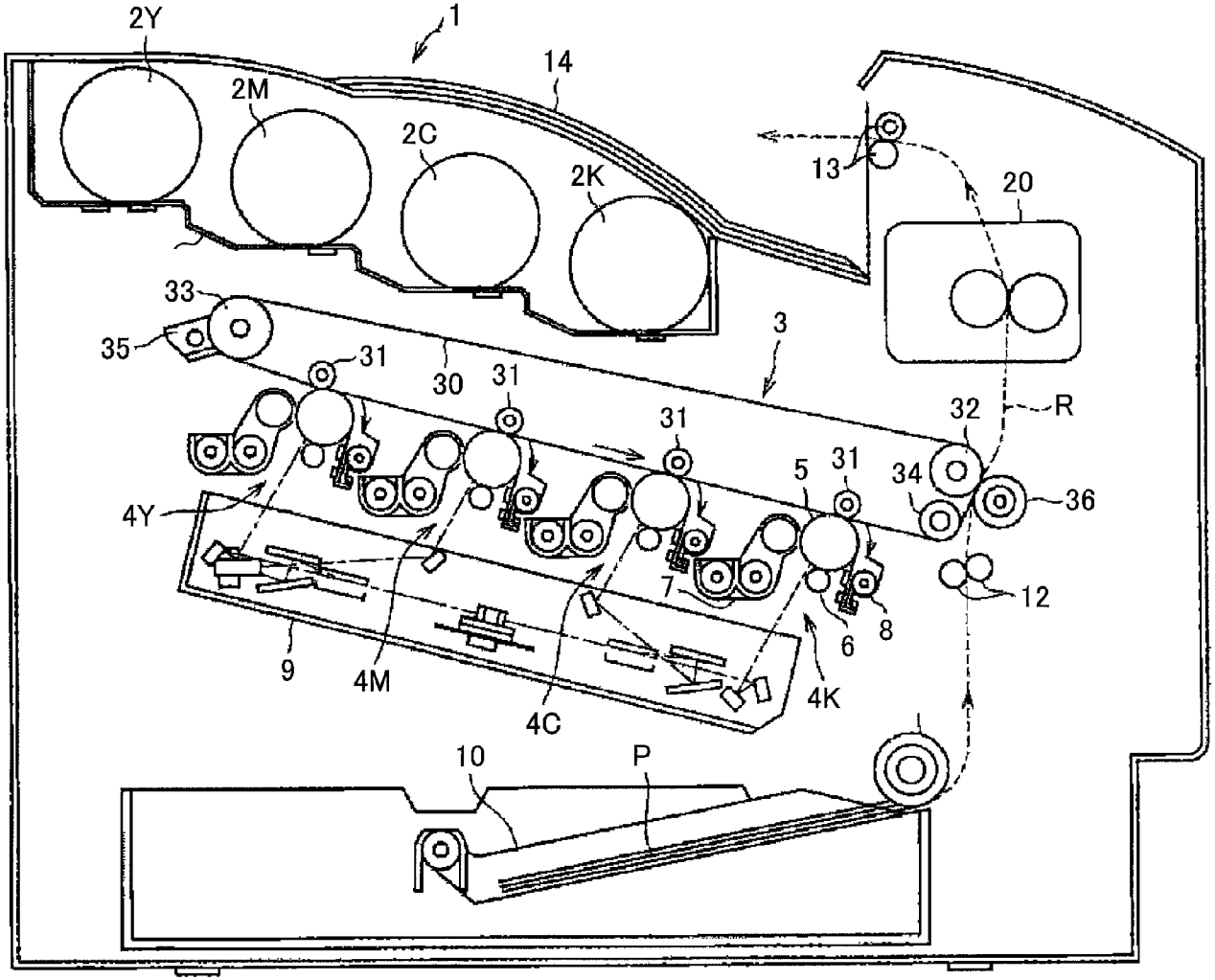
FIG. 2 is a diagram showing a composition of an image forming apparatus in which a fixing device according to an embodiment is provided.

The image forming apparatus 1 shown in FIG. 2 is a color laser printer. Four image formation units 4Y, 4M, 4C and 4K are arranged in the middle of a main body of the image forming apparatus 1. The image formation units 4Y, 4M, 4C and 4K have the same composition but contain developers of different colors which are yellow (Y), magenta (M), cyan (C) and black (K) corresponding to color separation components of a color image.

Specifically, each of the image formation units 4Y, 4M, 4C and 4K includes a drum-like photoconductor 5 as a latent image support, a charging device 6 to charge a surface of the photoconductor 5, a developing device 7 to supply toner to the surface of the photoconductor 5, a cleaning device 8 to clean the surface of the photoconductor 5, etc.

In FIG. 2, the reference numerals are given only to the photoconductor 5, the charging device 6, the developing device 7 and the cleaning device 8 which are provided in the black image formation unit 4K, and the reference numerals are omitted for those components provided in other image formation units 4Y, 4M and 4C, for the sake of convenience.

Below the image formation units 4Y, 4M, 4C and 4K, an exposure device 9 to expose the surface of the photoconductor 5 to laser light is arranged. The exposure device 9 includes a light source, a polygon mirror, an f-θ lens, a reflection mirror, etc., and emits a laser beam to the surface of each photoconductor 5 in accordance with image data.

Above the image formation units 4Y, 4M, 4C and 4K, a transfer device 3 is arranged. The transfer device includes an intermediate transfer belt 30, four primary transfer rollers 31, a secondary transfer roller 36, a secondary transfer backup roller 32, a cleaning backup roller 33, a tension roller 34, and a belt cleaning device 35.

The intermediate transfer belt 30 is an endless belt, and this intermediate transfer belt 30 is stretched by the secondary transfer backup roller 32, the cleaning backup roller 33 and the tension roller 34. In this example, when the secondary transfer backup roller 32 is rotated, the intermediate transfer belt 30 is circulated (or rotated) in a direction indicated by the arrow in FIG. 2.

The intermediate transfer belt 30 is sandwiched between the primary transfer rollers 31 and the photoconductors 5, and the primary transfer rollers 31 and the photoconductors 5 form primary transfer nips, respectively. A power supply which is not illustrated is connected to each of the primary transfer rollers 31, so that at least one of a predetermined direct current (DC) voltage and a predetermined alternating current (AC) voltage is applied to each of the primary transfer rollers 31.

Further, the intermediate transfer belt 30 is sandwiched between the secondary transfer roller 36 and the secondary transfer backup roller 32, and the secondary transfer roller 36 and the secondary transfer backup roller 32 form a secondary transfer nip. Similar to the primary transfer rollers 31, a power supply which is not illustrated is connected to the secondary transfer roller 36, so that at least one of a predetermined direct current (DC) voltage and a predetermined alternating current (AC) voltage is applied to the secondary transfer roller 36.

The belt cleaning device 35 includes a cleaning brush and a cleaning blade which are arranged to contact the intermediate transfer belt 30. A waste toner transfer hose which is not illustrated is extended from the belt cleaning device 35 and connected to an inlet portion of a waste toner accommodation container which is not illustrated.

At an upper part of the main body of the image forming apparatus 1, a bottle accommodation portion is provided, and four toner bottles 2Y, 2M, 2C and 2K, each containing a replenishment toner, are detachably arranged in the bottle accommodation portion. A supply path which is not illustrated is provided between each of the toner bottles 2Y, 2M, 2C and 2K and the corresponding one of the developing devices 7. The toners are supplied from the toner bottles 2Y, 2M, 2C and 2K to the developing devices 7 via the supply paths, respectively.

At a lower part of the main body of the image forming apparatus 1, a sheet feed tray 10 to accommodate sheets P as recording media, and a sheet feed roller 11 to supply the sheets P one at time from the sheet feed tray 10 are provided. In this example, the recording medium may include a plain sheet of paper, a cardboard, a postcard, an envelope, a thin sheet, a coated sheet, an art sheet, a tracing paper sheet, an OHP (overhead projector) sheet, etc. Although not illustrated, a manual feed mechanism may be arranged in the image forming apparatus 1.

In the main body of the image forming apparatus 1, a sheet transport path R is arranged for allowing the sheet P from the sheet feed tray 10 to pass through the secondary transfer nip and for ejecting the sheet P from the image forming apparatus. In the sheet transport path R, a pair of registration rollers 12 as a transport unit that transports the sheet P to the secondary transfer nip is arranged at an upstream position from the position of the secondary transfer roller 36 in the sheet transport direction.

At a downstream position from the position of the secondary transfer roller 36 in the sheet transport direction, a fixing device 20 is arranged for fixing the transferred image to the sheet P. At a downstream position of the sheet transport path R from the position of the fixing device 20 in the sheet transport direction, a pair of sheet output rollers 13 is arranged for ejecting the sheet P from the image forming apparatus 1. Further, a sheet output tray 14 for stacking the sheets P ejected from the image forming apparatus is arranged on an upper surface of the main body of the image forming apparatus 1.

A basic operation of the image forming apparatus is explained. Upon a start of an image forming operation, the photoconductor 5 in each of the image formation units 4Y, 4M, 4C and 4K is rotated clockwise by a non-illustrated driving motor, and the surface of the photoconductor 5 is uniformly charged in a predetermined polarity by the charging device 6.

A laser beam is emitted to the charged surface of the photoconductor 5 by the exposure device 9, so that an electrostatic latent image is formed on the surface of the photoconductor 5. At this time, the image information by which an image is formed on the photoconductor 5 is monochrome image information of one of yellow, magenta, cyan and black, corresponding to color separation components of a desired color image. The electrostatic latent image is converted into a toner image by supplying the toner to the electrostatic latent image formed on the surface of the photoconductor 5 by the developing device 7.

When the image forming operation is started, the secondary transfer backup roller 32 is rotated in the counter-clockwise direction, and the intermediate transfer belt 30 is circulated in the direction indicated by the arrow in FIG. 2. A constant voltage or a constant-current controlled voltage in the polarity reverse to the charged polarity of the toner is supplied to the primary transfer roller 31. Thereby, a transfer electric field is formed in the primary transfer nip between the primary transfer roller 31 and the photoconductor 5.

Subsequently, when the toner image of each color on the photoconductor 5 reaches the primary transfer nip by rotation of the photoconductor 5, the toner image on the photoconductor 5 is transferred to the intermediate transfer belt 30 by the transfer electric field formed in the primary transfer nip. In this way, a full color toner image is formed on the surface of the intermediate transfer belt 30.

The toner on the photoconductor 5 which has not been transferred to the intermediate transfer belt 30 is removed by the cleaning device 8. Then, by an electric discharger (which is not illustrated), the electricity of the surface of the photoconductor 5 is discharged and the photoconductor surface potential is initialized.

In the lower part of the image forming apparatus, the rotation of the sheet feed roller 11 is started and the sheet P from the sheet feed tray 10 is supplied to the sheet transport path R. The sheet P supplied to the sheet transport path R is transported to the secondary transfer nip between the secondary transfer roller 36 and the secondary transfer backup roller 32 in an appropriate time by the registration rollers 12. At this time, the transfer voltage in the polarity reverse to the charged polarity of the toner image on the intermediate transfer belt 30 is applied to the secondary transfer roller 36, and the transfer electric field is formed in the secondary transfer nip.

Subsequently, when the toner image on the intermediate transfer belt 30 reaches the secondary transfer nip by the circulating movement of the intermediate transfer belt 30, the toner image on the intermediate transfer belt 30 is transferred to the sheet P by the transfer electric field formed in the secondary transfer nip. At this time, the residual toner on the intermediate transfer belt 30 which has not been transferred to the sheet P is removed by the belt cleaning device 35, and the removed toner is supplied to and collected by the waste toner accommodation container which is not illustrated.

Subsequently, the sheet P is transported to the fixing device 20, and the toner image on the sheet P is fixed to the sheet P by the fixing device 20. The sheet P is ejected from the image forming apparatus by the sheet output roller 13, so that the sheet P is stacked on the sheet output tray 14.

In the above description, the image formation operation is performed to form a color image on the sheet P. In addition, a monochrome image may be formed using any one of the four image formation units 4Y, 4M, 4C and 4K, or a two-color or three-color image may be formed using two or three image formation units.

The image forming apparatuses according to the related art output a reproduced image by using the known electrophotographic method. That is, an electrostatic latent image formed on a photoconductor as a latent-image support is converted into a visible toner image, the toner image is transferred to a recording medium, such as a sheet, and the reproduced image is output by fixing the toner image to the recording medium.

The fixing methods used for the image forming apparatuses include a thermal roller fixing method, a belt fixing method, a film fixing method, an electromagnetic induction-heating fixing method, etc.

The thermal roller fixing method utilizes a fixing roller and a pressure roller which are arranged on opposite sides of a transport path of a sheet to sandwich the sheet between the fixing roller and the pressure roller. In this method, the toner image is fixed to the sheet by applying the heat due to a heat source provided in the fixing roller and the pressure due to a pressing force of the pressure roller. The phenomenon in which the toner image is fixed to the sheet is the same also in the following fixing methods.

The belt fixing method utilizes, instead of the fixing roller, a fixing belt as a thermal conductor, a roller engaged with a pressure roller and the fixing belt, and a heating source to heat the fixing belt. For example, see Japanese Laid-Open Patent Publication No. 2004-286922.

The film fixing method utilizes, instead of the fixing roller, a fixing belt as a thermal conductor, a roller engaged with a pressure roller and the fixing belt, and a heating source to heat the fixing belt. For example, see Japanese Laid-Open Patent Publication No. 2010-079309.

The electromagnetic induction-heating fixing method utilizes a structure in which an electromagnetic induction coil is provided as a heating source to increase thermal efficiency. For example, see Japanese Laid-Open Patent Publication No. 2004-286922.

An aspect of the fixing method according to the present invention is to shorten a warm-up time and shorten a first print time. The warm-up time is the time needed to reach a predetermined temperature (reload temperature) at which the image forming apparatus is ready for printing from a normal temperature state upon a startup. The first print time is the time needed to complete a printing operation including printing preparation and a sheet output operation after a printing request is received.

In the fixing devices according to the related art, poor fixing may take place when continuous printing of a large number of sheets is performed by the image forming apparatus at high speed.

Apart from the above-described fixing methods according to the related art, there is a fixing method using a ceramic heater which is called a SURF fixing method. The SURF fixing method utilizes a structure in which only a nip portion is heated locally and other portions are not heated. In this fixing method, thermal capacity may be reduced and a small-sized fixing device may be provided when compared with the belt fixing method, so that the warm-up time may be shortened and the first print time may be shortened. However, the SURF fixing method has the following problem.

Namely, in the SURF fixing method, the portions other than the nip portion are not heated, and the fixing belt at a sheet entering portion is in a cold state, so that poor fixing is likely to take place there. In particular, in a case of a high-speed color printer, the rotational speed of the fixing belt is high, the heat consumption of the fixing belt portions other than the nip portion is great, and thus poor fixing is more likely to take place.

To eliminate the problem, an improved fixing device using a fixing belt is proposed in which good fixing property may be maintained even if it is used in a high-speed image forming apparatus. For example, see Japanese Laid-Open Patent Publication No. 2007-334205.

Figure 3:
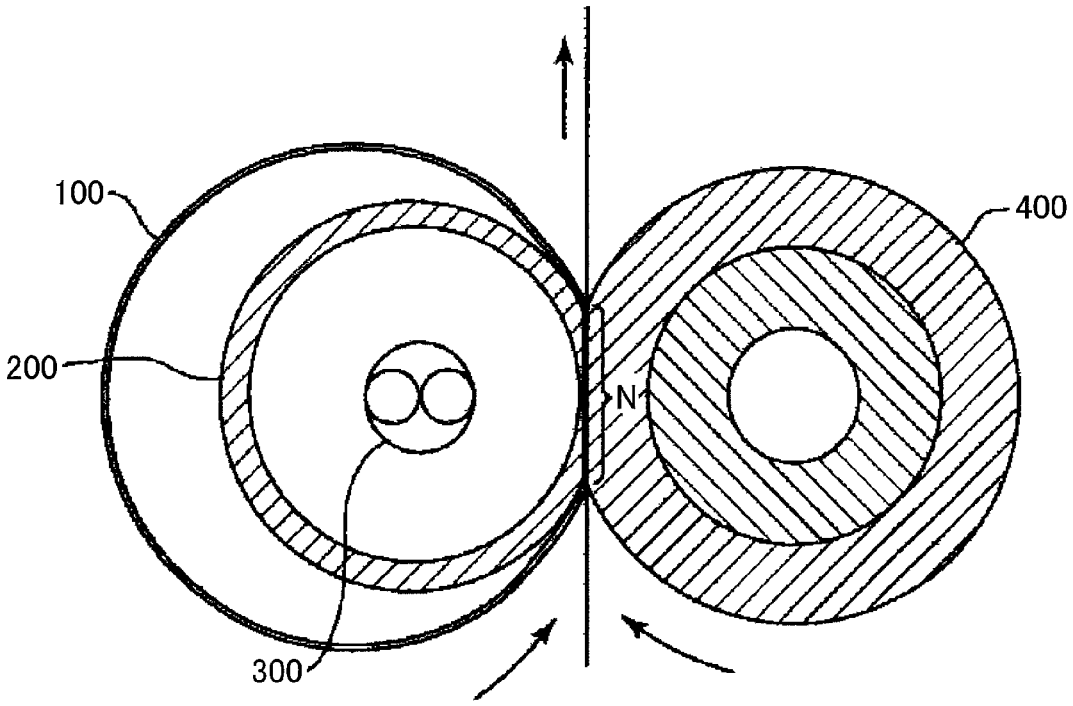
FIG.3 RELATED ART
FIG. 3 is a diagram showing a composition of a fixing device according to the related art.

FIG. 3 shows a composition of a fixing device according to the related art as disclosed in Japanese Laid-Open Patent Publication No. 2007-334205. This fixing device includes a fixing belt 100, a pipe-like metallic thermal conductor 200 disposed in the fixing belt 100, a heat source 300 disposed in the metallic thermal conductor 200, and a pressure roller 400 which is brought in contact with the metallic thermal conductor 200 via the fixing belt 100 to form a nip portion N.

The fixing belt 100 is rotated by rotation of the pressure roller 400, and the metallic thermal conductor 200 guides the movement of the fixing belt 100 at this time. The fixing belt 100 is heated through the metallic thermal conductor 200 by the heat source 300 in the metallic thermal conductor 200, and the whole fixing belt 100 may be warmed. Thus, the first print time measured from a heating standby state may be shortened and the lack of heat at a time of a high speed rotation may be prevented.

However, in order to improve the energy saving property and the first print time, it is necessary to further increase thermal efficiency. In a fixing device 20 according to an embodiment, a fixing belt 21 is not heated indirectly via a metallic thermal conductor (which is equivalent to the element 200 in FIG. 3), but the fixing belt 21 is directly heated without using the metallic thermal conductor. Thereby, the heat consumption may be reduced and the first print time measured from the heating standby state may be further shortened. In the fixing device according to the embodiment, the metallic thermal conductor is not used, and cost reduction may be expected.

Figure 4:
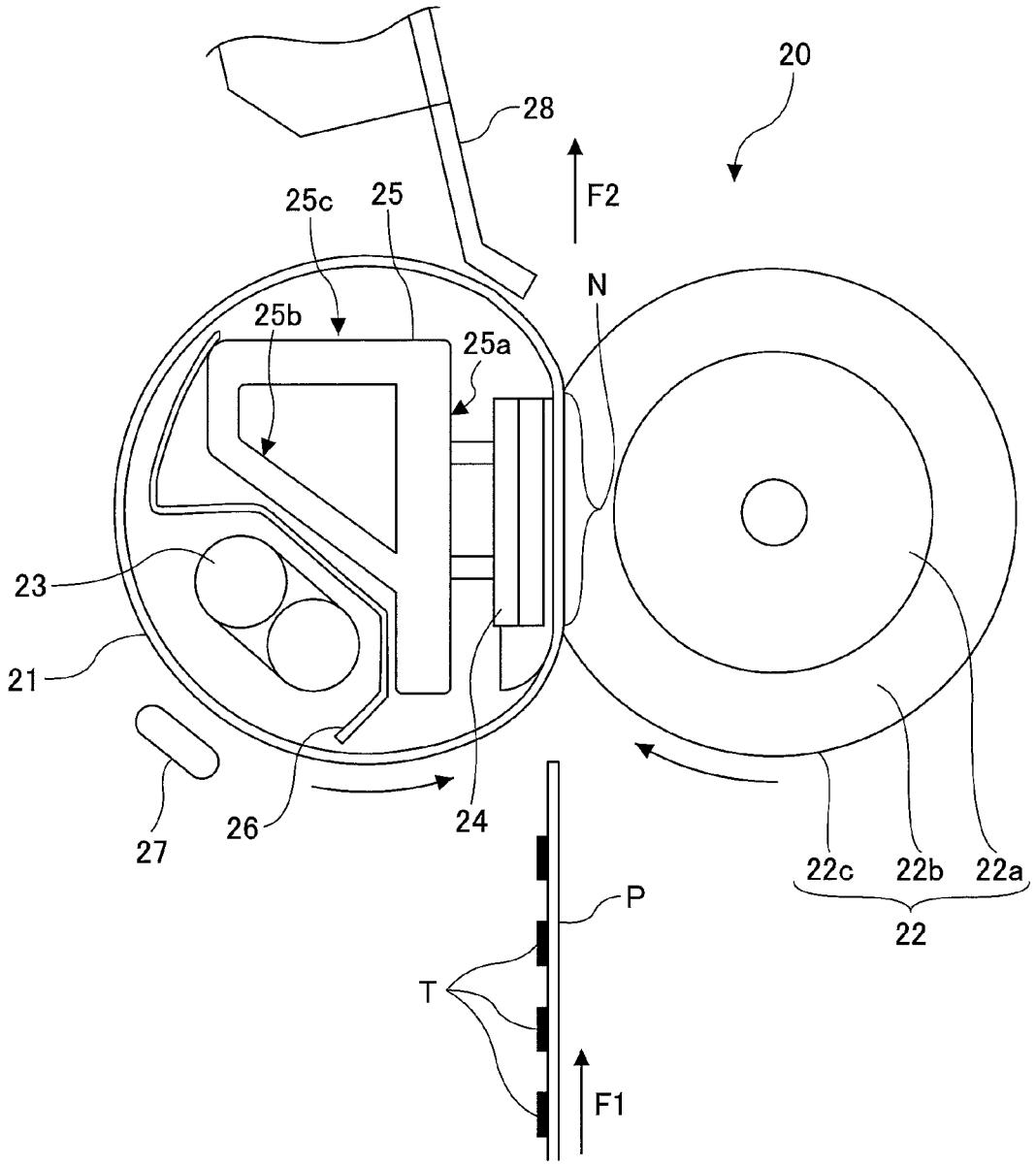
FIG. 4 is a diagram showing the composition of the fixing device according to the embodiment.

Next, the composition of the fixing device 20 according to the embodiment is explained with reference to FIG. 4. FIG. 4 is a diagram showing the composition of the fixing device 20 according to this embodiment.

As shown in FIG. 4, the fixing device 20 includes a fixing belt 21 as a hollow endless fixing member, and a pressure roller 22 as a pressure member including a rotatably supported roller confronting the fixing belt 21.

Provided inside the fixing belt 21 are halogen heaters 23 and a nip formation member 24. Each of the halogen heaters 23 is a heat source to heat the fixing belt 21. In this embodiment, the two halogen heaters 23 each including a heating portion (filament) enclosed in a glass tube are utilized. However, the present disclosure is not limited to this embodiment. For example, one halogen heater including two heating portions (filaments) enclosed in a glass tube may be used instead.

The nip formation member 24 is provided to form a nip portion N with the pressure roller 22 confronting the fixing belt 21. Further provided inside the fixing belt 21 are a stay 25 and a reflector member 26. The stay 25 is a support member to support the nip formation member 24. The reflector member 26 is provided to reflect the light emitted from the halogen heaters 23 to the fixing belt 21.

The fixing device 20 further includes a temperature sensor 27 as a temperature detecting unit to detect a temperature of the fixing belt 21, a separation member 28 as a sheet separation unit to separate the sheet P from the fixing belt 21, and a pressing unit (not illustrated) to press the pressure roller 22 onto the fixing belt 21.

The fixing belt 21 is implemented by an endless thin-walled belt member (also including a film) of a flexible material. The fixing belt 21 includes a base plate on its inner peripheral side, the base plate made of a metallic material, such as nickel or stainless steel, or a resin material, such as polyimide resin (PI). The fixing belt 21 further includes a release layer on its outer peripheral side, the release layer made of tetrafluoroethylene-perfluoroalkoxyethylene copolymer (PFA) or polytetrafluoroethylene (PTFE). The fixing belt 21 may further include an elastic layer between the base plate and the release layer, the elastic layer made of a rubber material, such as silicone rubber, silicone foam rubber or fluoro-rubber.

The pressure roller 22 is implemented by a core metal 22*a*, an elastic layer 22*b* and a release layer 22*c*. The elastic layer 22*b* is formed on a surface of the core metal 22*a* and implemented by silicone foam rubber, silicone rubber or fluoro-rubber. The release layer 22 is formed on a surface of the elastic layer 22*b* and implemented by PFA or PTFE. The pressure roller 22 is pressed onto the fixing belt 21 by the pressing unit (not illustrated) to be in contact with the nip formation member 24 via the fixing belt 21.

At the portion where the pressure roller 22 is pressed onto the fixing belt 21, the elastic layer 22*b* of the pressure roller 22 is compressed, and the nip portion N with a predetermined width is formed.

The pressure roller 22 is rotated by a drive source (not illustrated), such as a motor, disposed in the main body of the image forming apparatus. When the pressure roller 22 is rotated, the drive force is transmitted to the fixing belt 21 via the nip portion N, and the fixing belt 21 is caused to be rotated.

In this embodiment, the pressure roller 22 is implemented by a solid roller. Alternatively, the pressure roller 22 may be implemented by a hollow roller. In such a case, a heat source, such as a halogen heater, may be disposed in the pressure roller 22. If no elastic layer 22*b* is formed, thermal capacity is reduced and a good fixing property is provided. However, when the transferred toner image is fixed to the sheet, minute irregularities on the belt surface may be transferred to the image, and gloss unevenness may appear in a solid portion of the image. In order to prevent the gloss unevenness, it is preferred to provide the elastic layer having a thickness of 100 μm or greater.

If the elastic layer having a thickness of 100 μm or greater is provided, the minute irregularities may be reduced by the elastic deformation of the elastic layer, and the occurrence of gloss unevenness may be avoided. The elastic layer 22*b* may be implemented by solid rubber. When no heat source is provided in the pressure roller 22, the elastic layer 22*b* may be implemented by sponge rubber. The use of sponge rubber is more desirable because the heat insulation property of the fixing belt 21 increases. The fixing member 21 and the roller 22 may be arranged such that the fixing member 21 and the roller 22 are merely in contact with each other without pressurization.

The end portions of each of the halogen heaters 23 are secured to side plates (not illustrated) of the fixing device 20, respectively. The power of the halogen heaters 23 is controlled by a power supply unit provided in the main body of the image forming apparatus. The power control of the halogen heaters 23 is performed based on a detection result of a temperature of the surface of the fixing belt 21 detected by the temperature sensor 27. By performing the power control of the halogen heaters 23, the temperature (fixing temperature) of the fixing belt 21 may be maintained at a desired temperature. The heat source to heat the fixing belt 21 may also be implemented by any of an IH (electromagnetic induction) heater, a resistance heating element, a carbon heater, etc., other than the halogen heater.

Figure 5:
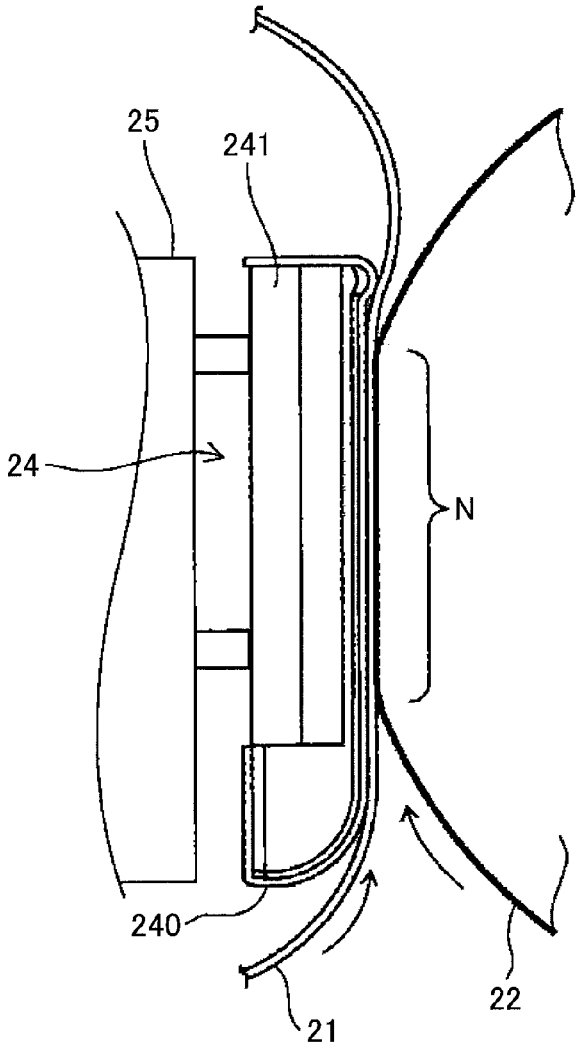
FIG. 5 is a diagram showing a composition of a nip formation member in the fixing device according to the embodiment.

FIG. 5 shows a composition of the nip formation member 24. As shown in FIG. 5, the nip formation member 24 includes a base pad 241 and a low-friction slide sheet 240 to cover the base pad 241.

The base pad 241 is a component which is provided to determine a configuration of the nip portion N in response to the pressing force of the pressure roller 22. The base pad 241 is arranged in parallel with the axial direction of the fixing belt 21 or the axial direction of the pressure roller 22, and fixed and supported by the stay 25 which is used as a support member of the nip formation member 24. The base pad 241 is implemented by resin, such as liquid crystal polymer (LCP), metal, or ceramics, which will be described later.

In this way, the nip formation member 24 is supported by the stay 25, the occurrence of bending of the nip formation member 24 due to the pressure of the pressure roller 22 is prevented, and a nip with a uniform width is formed in parallel with the axial direction of the pressure roller 22.

In order to prevent the bending of the nip formation member 24, it is desirable that the stay 25 is implemented by a metallic material with high mechanical strength, such as stainless steel or iron. However, the stay 25 may also be implemented by a resin material.

The base pad 241 is implemented by a heat-resistant component with a heat-resistant temperature of 200° C. or higher. Thereby, deformation of the base pad 241 due to heat in a toner fixing temperature region may be prevented, and the state of the nip portion N may be stabilized. As a result, the quality of the reproduced image may be stabilized.

The base pad 241 may be implemented by a commonly used heat-resistant resin. For example, the base pad 241 may be implemented by any of polyethersulfone (PES), polyphenylenesulfide (PPS), liquid crystal polymer (LCP), polyethernitrile (PEN), polyamide-imide (PAI), polyetheretherketone (PEEK), etc.

The slide sheet 240 with a low friction coefficient is disposed on at least the surface of the base pad 241 facing the fixing belt 21. The slide sheet 240 causes the surface of the fixing belt 21 to slide when the fixing belt 21 is rotated. The slide sheet 240 is provided to reduce the load by the frictional force on the fixing belt 21 and reduce the drive torque on the fixing belt 21 which is caused to slide by the slide sheet 240. For example, the slide sheet 240 is implemented by PTFE or the like.

The base pad 241 is provided to determine the configuration of the nip portion N which is formed with the pressure roller 22 facing the base pad 241 via the slide sheet 240. A surface of the base pad 241 which faces the nip portion N is formed into a substantially flat or straight surface. In order to maintain such a flat surface, the base pad 241 is implemented by a material with an adequate hardness. For example, the base pad 241 is implemented by a molding of a crystalline thermoplastics resin for liquid crystal polymer (LCP), or aramid fiber, etc. Alternatively, the base pad 241 may be implemented by metal, ceramics, etc., which is appropriate for maintaining the flat surface of the base pad 241, instead of the above-described resin.

The reflector member 26 is disposed between the stay 25 and the halogen heaters 23. The reflector member 26 is implemented by aluminum, stainless steel, etc., a surface of which is appropriate for providing a reflection surface.

The reflector member 26 is directly heated by the halogen heaters 23. Hence, it is preferred that the reflector member 26 is implemented by a metallic material of a high melting point. With the reflector member 26, the light emitted from the halogen heaters 23 toward the stay 25 side is reflected back to the fixing belt 21. By using the reflector member 26, the quantity of light to irradiate the fixing belt 21 may be increased and the fixing belt 21 may be efficiently heated. Further, the reflector member 26 serves to prevent the radiant heat from the halogen heaters 23 from being transmitted to the stay 25, and energy saving may also be provided.

Alternatively, without using the reflector member 26 as in the above embodiment, specular surface processing, such as polishing or painting, may be performed for a surface of the stay 25 facing the halogen heaters 23, to form a reflection surface. In addition, it is preferred that the reflection surface of the reflector member 26 or the stay 25 has a reflection factor of 90% or greater.

However, in order to secure the mechanical strength or rigidity, the configuration and the source material of the stay 25 are restricted or not to be freely selected. Hence, it is preferred that the reflector member 26 is additionally provided as in the above embodiment. In such a case, the reflector member 26 and the stay 25 may be specialized for their functions. In addition, the reflector member 26 is disposed between the halogen heaters 23 and the stay 25, and the distance between the reflector member 26 and the halogen heaters 23 is reduced, so that the fixing belt 21 may be efficiently heated.

In order to further increase the heating efficiency of the fixing belt 21 by reflection of light, it is necessary to optimize the direction of the reflection surface of the reflector member 26 or the stay 25. In the following, for the sake of simplicity, examples in which a single halogen heater is utilized will be described with reference to FIGS. 6A and 6B.

Figure 6A:
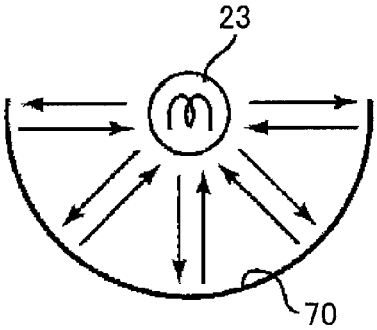
FIG. 6A is a diagram for explaining a case in which a reflection surface is arranged in the shape of a concentric circle centered on a halogen heater.

For example, in a case in which the reflection surface 70 is arranged in the shape of a concentric circle centered on the halogen heater 23 as shown in FIG. 6A, the light is reflected toward the halogen heater 23 and the heating efficiency will fall.

Figure 6B:
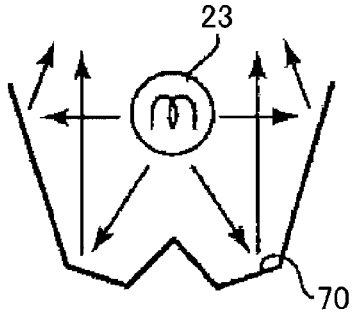
FIG. 6B is a diagram for explaining a case in which a reflection surface is arranged such that the light is reflected to the fixing belt by a part or all of the reflection surface in directions toward portions other than the halogen heater.

On the other hand, as shown in FIG. 6B, in a case in which the reflection surface 70 is arranged such that the light is reflected to the fixing belt by a part or all of the reflection surface 70 in directions toward portions of the fixing device other than the halogen heater 23, the quantity of light reflected in the directions toward the halogen heater 23 is reduced. In this embodiment, the reflection surface 70 of the reflector member 26 or the stay 25 is arranged as shown in FIG. 6B, and the heating efficiency by the reflected light may be increased.

The fixing device 20 according to this embodiment is improved in order to increase the energy saving property and shorten the first print time. Specifically, portions of the fixing belt 21 other than the nip portion N are directly heated by the halogen heater 23 (direct heating method).

In the fixing device 20 according to the embodiment shown in FIG. 4, no intervening object exists between the left-hand portion of the fixing belt 21 and the halogen heater 23 facing such portion. Hence, in the position where the halogen heater 23 and the fixing belt 21 face each other, the radiant heat from the halogen heater 23 is directly applied to the fixing belt 21.

In order to reduce thermal capacity of the fixing belt 21, a small-sized thin-walled fixing belt 21 is produced. Specifically, when the fixing belt 21 is constituted by the base plate, the elastic layer and the release layer, the base plate has a thickness in a range of 20-50 μm, the elastic layer has a thickness in a range of 100-300 μm, the release layer a thickness in a range of 5-50 μm, and the fixing belt 21 as a whole has a thickness of 1 mm or less. Further, the fixing belt 21 has a diameter of 20-40 mm. In order to reduce thermal capacity, it is desirable that the fixing belt 21 as a whole has a thickness of 0.2 mm or less. It is more desirable that the fixing belt 21 as a whole has a thickness of 0.16 mm or less. It is desirable that the fixing belt 21 has a diameter of 30 mm or less.

In the fixing device 20 according to the embodiment, the pressure roller 22 has a diameter of 20-40 mm, and the diameter of the fixing belt 21 is equal to the diameter of the pressure roller 22. However, the present disclosure is not limited to this embodiment. For example, the diameter of the fixing belt 21 may be smaller than the diameter of the pressure roller 22. In such a case, the curvature of the fixing belt 21 in the nip portion N is smaller than the curvature of the pressure roller 22, and the recording medium ejected from the nip portion N may be easily separated from the fixing belt 21.

Figure 7A:
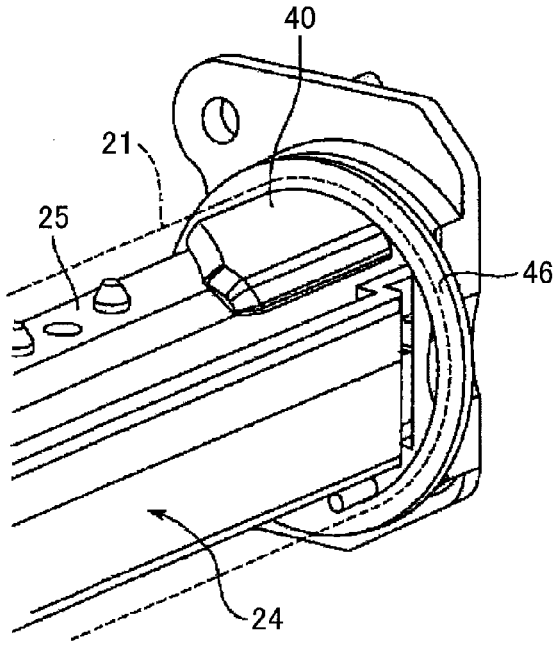
FIG. 7A is a perspective view of an end portion of the fixing device in the axial direction.
Figure 7B:
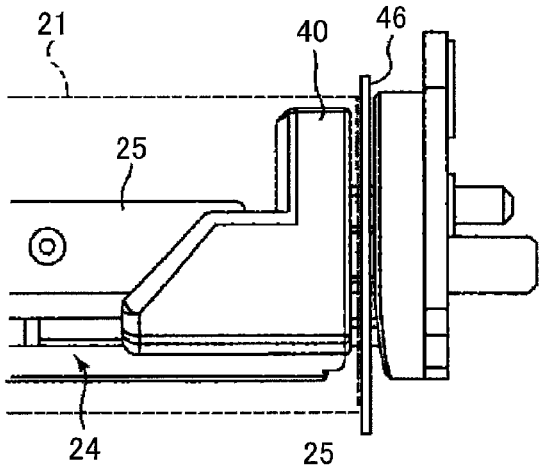
FIG. 7B is a plan view of the end portion of the fixing device in the axial direction.
Figure 7C:
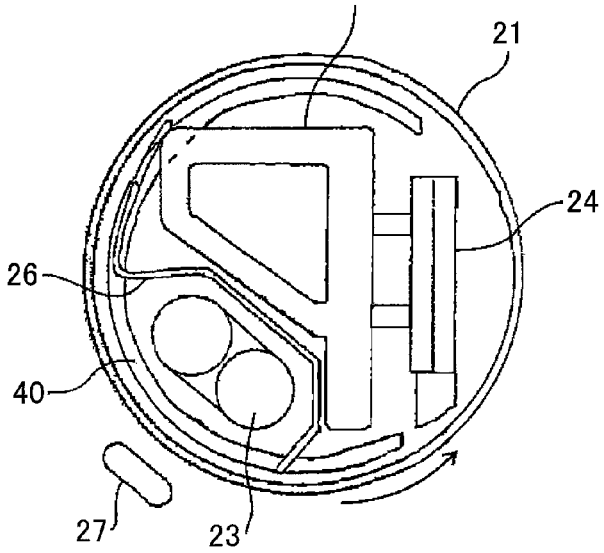
FIG. 7C is a side view of the fixing device when viewed from the axial direction.

FIG. 7A is a perspective view of an end portion of the fixing device 20 in the fixing belt axial direction (width direction), FIG. 7B is a plan view of the end portion of the fixing device 20 in the fixing belt axial direction, and FIG. 7C is a side view of the fixing device 20 when viewed from the axial direction.

In FIGS. 7A-7C, only the end portion on one side of the fixing device 20 in the fixing belt axial direction is illustrated. The end portion on the opposite side of the fixing device 20 also has the same composition as illustrated, and a description thereof will be omitted. In the following, referring to FIGS. 7A-7C, only the composition of the end portion on one side of the fixing device 20 in the fixing belt axial direction is explained.

As shown in FIGS. 7A and 7B, a flange 40 as a belt holding component is inserted in the end portion of the fixing belt 21 in the axial direction, and the end portion of the fixing belt 21 is rotatably held by the flange 40. The flange 40 includes a guide portion to stop decentering of the fixing belt 21, and a rotation guide portion to guide rotation of the fixing belt 21.

As shown in FIG. 7C, the flange 40 is formed to have a C-shaped cross-section which is open at a position of the nip portion (a position where the nip formation member 24 is disposed). An end portion of the stay 25 is fixed to the flange 40 and the stay 25 is positioned.

As shown in FIG. 7A and FIG. 7B, a slip ring 46 as a protection component to protect the end portion of the fixing belt 21 in the axial direction is disposed between the end face of the fixing belt 21 and its confronting surface of the flange 40.

Because the guide portion of the flange 40 is not rotated during rotation of the fixing belt 21, wear may arise in the guide portion due to contact with the end face of the fixing belt 21. The slip ring 46 which is rotatable with the fixing belt 21 during rotation of the fixing belt 21 is disposed between the fixing belt 21 and the guide portion of the flange 40. Hence, even if decentering of the fixing belt 21 with respect to the axial direction (width direction) arises, the end face of the fixing belt 21 may be prevented from directly contacting the guide portion of the flange 40, and wear or breakage of the end face of the fixing belt 21 may be prevented.

The slip ring 46 is fitted with a margin to the outer peripheral surface of the flange 40. When the end face of the fixing belt 21 contacts the slip ring 46, the slip ring 46 is provided to be rotatable with the fixing belt 21, but the slip ring 46 may stand still at this time.

It is preferred that the slip ring 46 is implemented by a known super engineering plastic which is excellent in heat resistance, such as PEEK, PPS, PAI, PTFE, etc.

Figure 8:
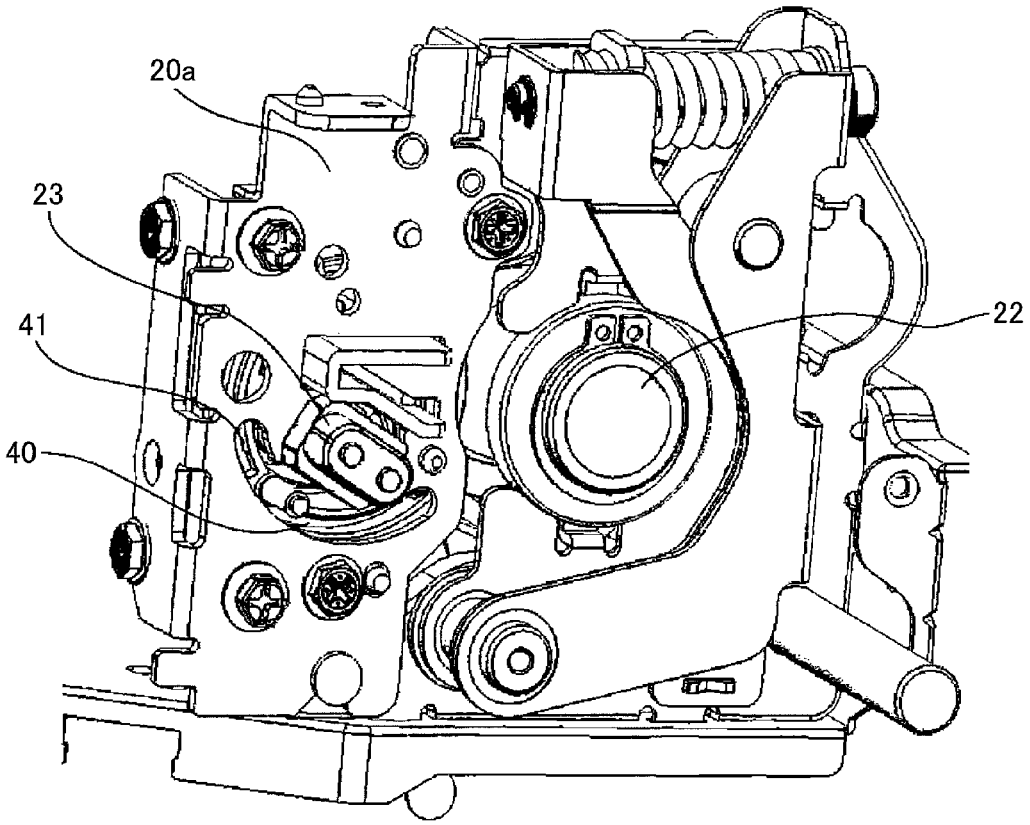
FIG. 8 is a diagram showing a state in which a flange, halogen heaters, and a stay are fixed to and supported by a side plate of the fixing device.

As shown in FIG. 8, the end portions of the flange 40, the halogen heaters 23 and the stay 25 are fixed to and supported by a side plate 20*a* of the fixing device 20. Similarly, the end portions of the flange 40, the halogen heaters 23 and the stay 25 on the opposite side are also fixed to and supported by a side plate (not illustrated) of the fixing device 20.

Although not illustrated, shield members to shield the fixing belt 21 from the heat from the halogen heaters 23 are disposed between the fixing belt 21 and the halogen heaters 23 at both the end portions of the fixing belt 21 in the axial direction. Hence, excessive heating of the fixing belt 21 in the non-sheet-feeding region at a time of continuous sheet feeding may be prevented, and degradation or breakage of the fixing belt 21 by heat may be prevented.

In this embodiment, only the flange 40 and the nip formation member 24 are in contact with the inner circumference surface of the fixing belt 21, and there is no additional belt guide member that is provided to contact the inner circumference surface of the fixing belt 21 and guide rotation of the fixing belt 21.

Next, a basic operation of the fixing device 20 according to the embodiment is explained with reference to FIG. 4.

When a power switch of the main body of the image forming apparatus is turned on, electric power is supplied to the halogen heaters 23 and rotation of the pressure roller 22 (which is the clockwise rotation in FIG. 4) is started. Thereby, rotation of the fixing belt 21 (which is the counterclockwise rotation in FIG. 4) is caused by the frictional force with the pressure roller 22.

Subsequently, a sheet P to which a toner image T is transferred by the above-described image formation process is transported in a direction indicated by the arrow F1 in FIG. 4, while it is guided by a non-illustrated guide plate, and fed to the nip portion N between the fixing belt 21 and the pressure roller 22 which are in a pressure contact state. The, the toner image T is fixed to the surface of the sheet P by the heat of the fixing belt 21 heated by the halogen heaters 23 and the pressing force between the fixing belt 21 and the pressure roller 22.

The sheet P to which the toner image T is fixed is transported from the nip portion N in a direction indicated by the arrow F2 in FIG. 4. At this time, the front end of the sheet P contacts the front end of the separation member 28, and the sheet P is separated from the fixing belt 21. Subsequently, the separated sheet P is ejected outside and stacked on the sheet output tray 14 (FIG. 2) by the sheet output roller 13 (FIG. 2) as described above.

Figure 1:
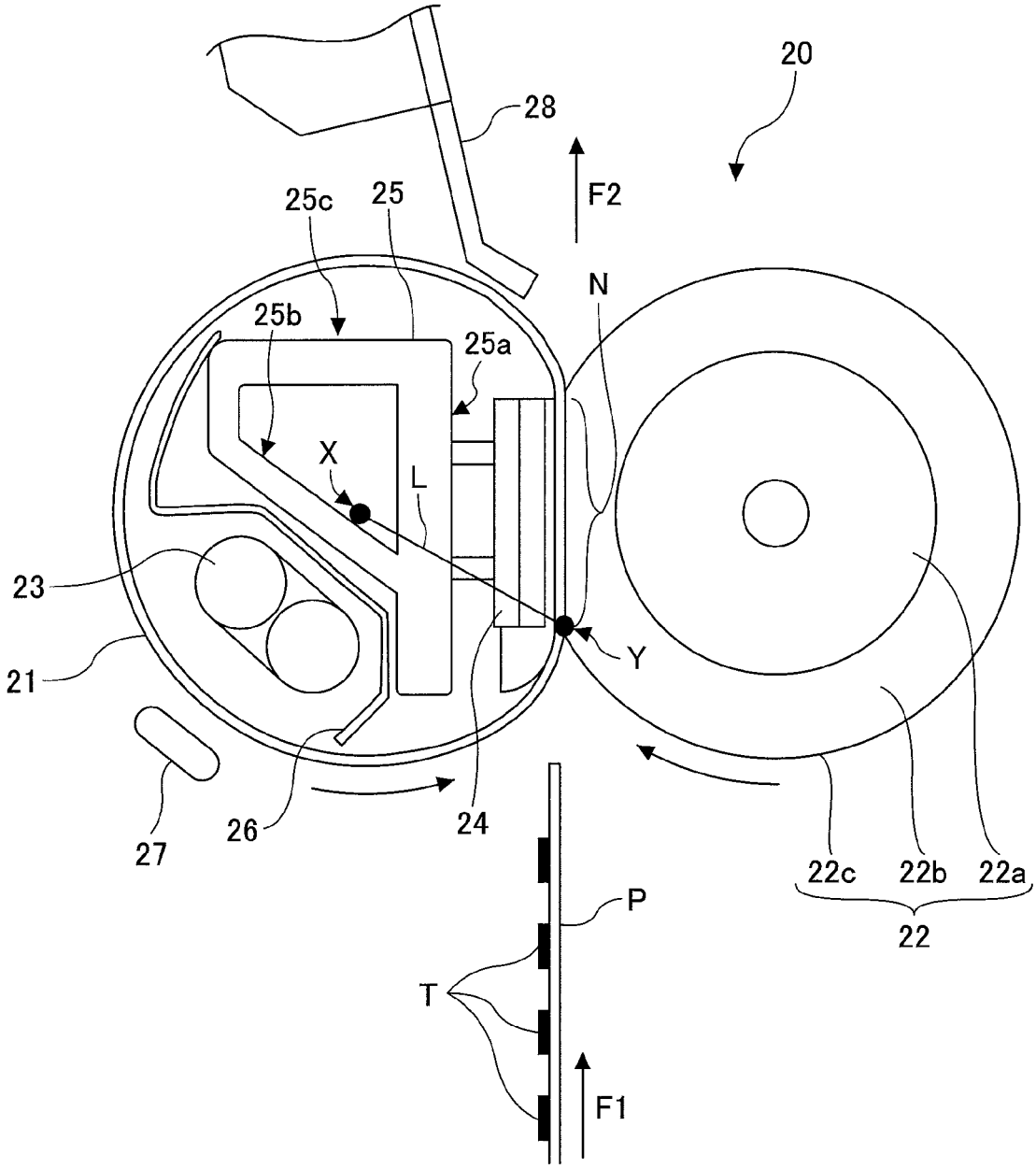
FIG. 1 is a diagram showing a composition of a fixing device according to an embodiment.

Next, a composition of the fixing device 20 according to the embodiment for use in the image forming apparatus 1 is explained. FIG. 1 is a diagram showing the composition of the fixing device according to the embodiment.

A detailed structure of the stay 25 is explained. As shown in FIG. 1, the stay 25 is configured to have a closed cross-section that is perpendicular to a longitudinal direction of the stay 25 (which direction is parallel to the fixing belt axial direction). The stay 25 includes at least a base portion 25*a* and rise portions 25*b* and 25*c*. The base portion 25*a* supports the nip formation member 24 and extends parallel to the sheet transport direction in the nip portion N. The rise portions 25*b* and 25*c* extend from the base portion 25*a* in directions drawn apart from the nip portion N.

In this embodiment, the rise portion 25*b* is inclined to the base portion 25*a* such that an inclination direction of the rise portion 25*b* is substantially parallel to a virtual straight line L connecting an inlet point Y of the nip portion N and a center X of rotation of the fixing belt 21, or falls within a range of rotational angles of ±15° by which the virtual straight line L is rotated around the center X of rotation.

The cross-section of the fixing belt 21 in the state where the fixing belt 21 and the pressure roller 22 are in pressure contact is not a true circle. Hence, the center X of rotation of the fixing belt 21 is defined as being a central position of the cross-section of the fixing belt 21 when the pressure roller 22 is disconnected from the fixing belt 21 and the fixing belt 21 is held by the flange 40 only.

Figure 9:
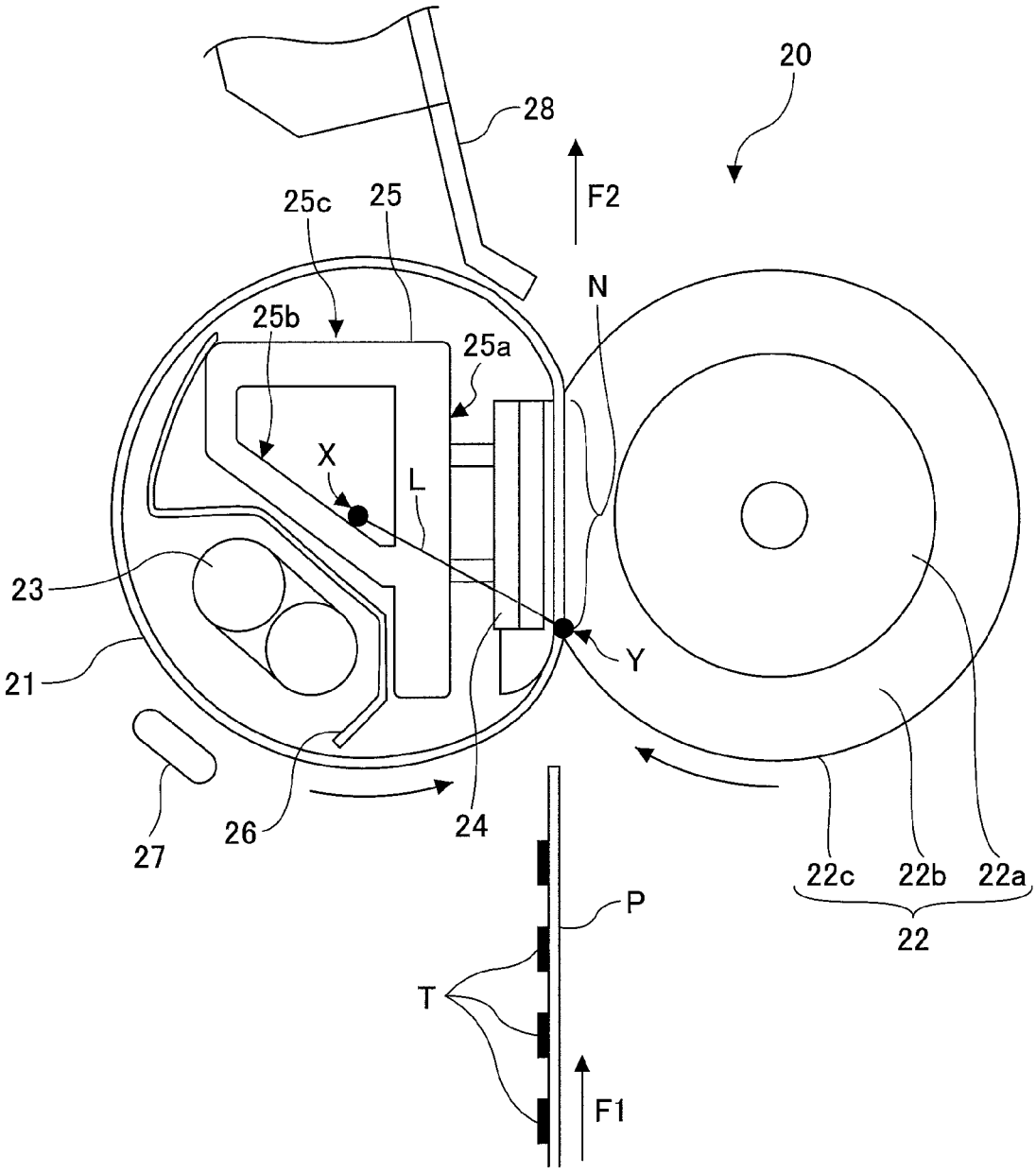
FIG. 9 is a diagram showing a composition of a fixing device according to another embodiment.

FIG. 9 is a diagram showing a composition of a fixing device according to another embodiment. As shown in FIG. 9, the fixing device may be configured such that the rise portion 25*b* is slightly elevated from the base portion 25*a* in a direction drawn apart from the nip portion N, and inclined to the base portion 25*a* such that an inclination direction of the rise portion 25*b* is substantially parallel to the virtual straight line L or falls within a range of rotational angles of ±15° by which the virtual straight line L is rotated around the center X of rotation. Thereby, the rise portion 25*b* including the elevated portion may increase the mechanical strength of the stay 25 as a whole when compared with a case in which the rise portion 25*b* is inclined to the base portion 25*a* in a straight manner.

In the stay 25 shown in FIG. 1, the rise portion 25*b* extends in an oblique direction to the base portion 25*a*, and the rise portion 25*c* extends in a direction at right angles to the base portion 25*a* apart from the nip portion N. However, the present disclosure is not limited to this embodiment. Alternatively, the stay 25 may be configured by inclining at least one of the rise portion 25*b* and the rise portion 25*c* to the base portion 25*a* such that an inclination direction of the at least one of the rise portions 25*b* and 25*c* is substantially parallel to the virtual straight line L or falls within a range of rotational angles of ±15° by which the virtual straight line L is rotated around the center X of rotation of the fixing belt 21.

Figure 10:
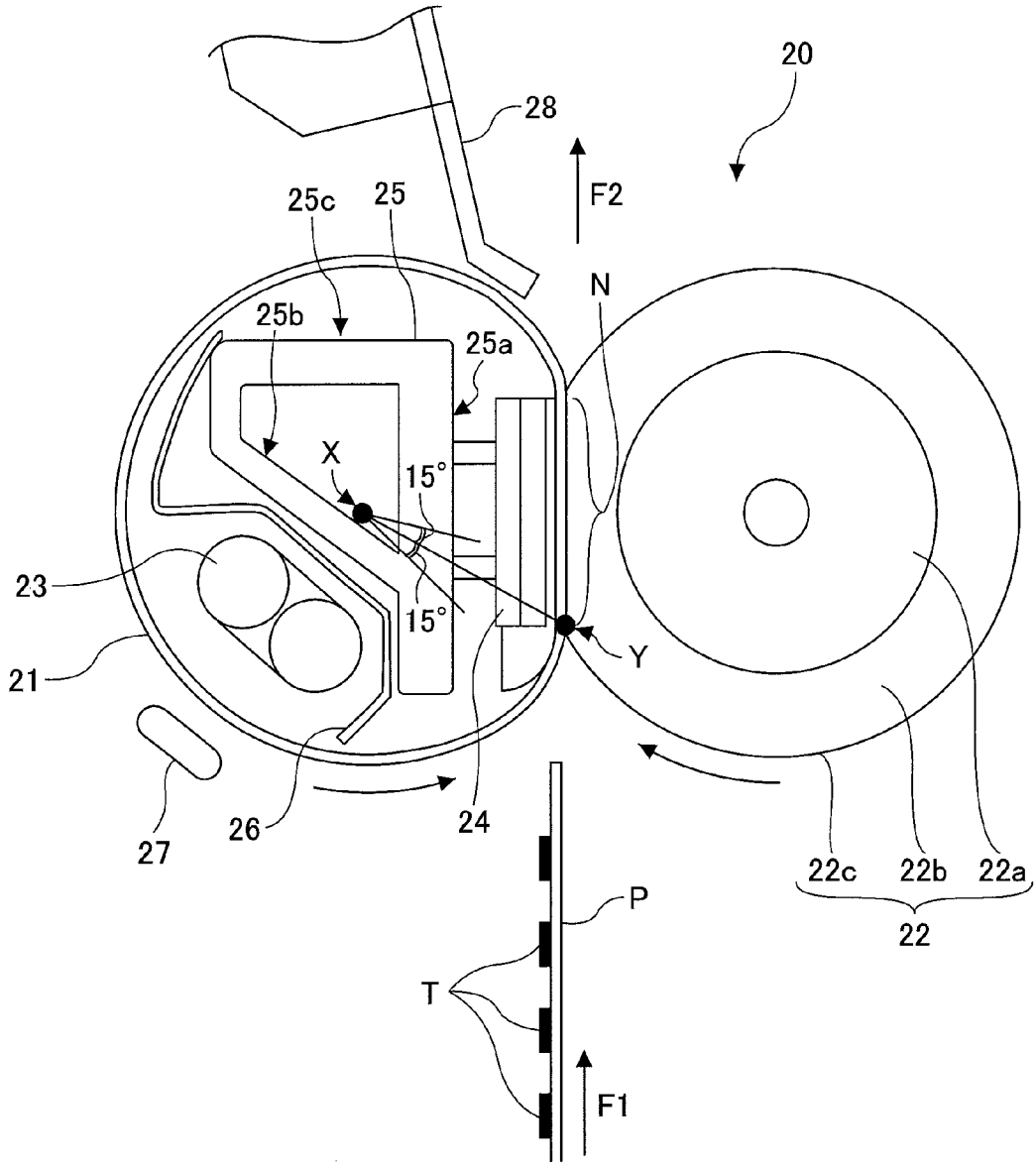
FIG. 10 is a diagram for explaining an inclination range of a rise portion of the stay in the fixing device shown in FIG. 1.

FIG. 10 is a diagram for explaining a range of rotational angles of ±15° by which the virtual straight line L connecting the center X of rotation of the fixing belt 21 and the inlet point Y of the nip portion N is rotated around the center X of rotation.

When the operation of the fixing device 20 is started (i.e., when the rotation of the fixing belt 21 is started), a dynamic load of the pressure roller 22 is exerted on the fixing belt 21 from the inlet point Y of the nip portion N to the center X of rotation of the fixing belt 21.

In the fixing device 20 according to this embodiment, the rise portion 25*b* is inclined to the base portion 25*a* as shown in FIG. 1, and the rise portion 25*b* may receive the force in the direction of the dynamic load to withstand the dynamic load. Hence, when compared with a case in which a rise portion extends from the same position of the base portion in a direction at right angles to the base portion, the force of the dynamic load acting in the oblique direction to the sheet transport direction in the nip portion N so as to bend the rise portion 25*b* may be reduced in the fixing device 20 according to the embodiment. The occurrence of bending or torsion of the stay 25 due to the force acting in the oblique direction may be prevented.

Accordingly, the mechanical strength of the stay 25 to withstand the dynamic load may be increased and the occurrence of bending or torsion of the nip formation member 24 when the rotation of the fixing belt 21 is started from a stop condition may be prevented.

In addition, the stay 25 has a cross-section that is long in the pressure direction of the pressure roller 22, and a section modulus of the stay 25 is increased to prevent the occurrence of bending of the stay 25 in the longitudinal direction by the pressing force of the pressure roller 22, so that the mechanical strength of the fixing belt 21 may be increased.

A section modulus is a coefficient computed based on a configuration of a cross-section as a basis for calculating the magnitude of a bending stress in a structural component. When a transverse load acts on the stay 25, bending of the stay 25 arises. The stress produced in the stay 25 by this bending action results in tension on the convex side adjacent to a neutral surface of the stay 25 where neither tension nor compression arises, and compression on the concave side adjacent to the neutral surface.

A bending stress of the stay 25 at a cross-section thereof is proportional to a distance of the cross-section from a neutral axis (a straight line passing through a centroid of the cross-section on an intersection line between the neutral surface and the cross-section) and reaches the maximum at the furthest point from the neutral axis. The section modulus is determined by dividing a second moment of area by a distance of the furthest point from the neutral axis. The section modulus is a constant which is determined by the configuration of the cross-section and the position of the neutral axis. By using a cross-section whose section modulus is large, even if the cross-sectional area thereof remains unchanged, the maximum bending stress arising in the stay 25 may be reduced.

The second moment of area is a measure of difficulty of deformation of an object to a bending moment. The second moment of area is expressed by "I" similar to the moment of inertia. When the cross-section of an object is changed, the value of the second moment of area is also changed. The second moment of area is used as a design index for increasing the durability of a structural component. The second moment of area is usually expressed in $cm^4$.

A surface pressure needed for preventing a slip in the nip portion N during rotation of the fixing belt is 0.6 $kgf/cm^2$ or greater. When the section modulus of the stay 25 is set to 200 $mm^3$ or greater, the pressure roller 22 is rotated in the nip portion N. When the drive force of the pressure roller 22 is transmitted to the fixing belt 21, bending of the stay 25 may be prevented. In addition, the cross-section of the stay 25 whose cross-sectional area is the same but whose section modulus is large is selected. The component parts may be efficiently arranged in the small-sized fixing belt 21.

In this embodiment, in order to increase the size of the stay 25 disposed in the fixing belt 21 as great as possible, the size of the nip formation member 24 is reduced. Specifically, the width of the nip formation member 24 in the sheet transport direction is smaller than the width of the stay 25 in the sheet transport direction.

In this embodiment, the portions of the fixing belt 21 other than the end portions are guided by the nip formation member 24 only, and the end portions of the fixing belt 21 are guided by the flange 40. There is no other guide member than the nip formation member 24 that is provided between the fixing belt 21 and the stay 25. The stay 25 may be disposed in the vicinity of the fixing belt 21, and the mechanical strength of the stay may be increased.

In this embodiment, the halogen heaters 23 are disposed at a downstream position of the rise portion 25*b* in the rotational direction of the fixing belt 21. Hence, the halogen heaters 23 and the stay 25 may be accommodated within the fixing belt 21 in a compact manner.

In this embodiment, the halogen heaters 23 as a heat source are disposed in the vicinity of the nip portion N, so that the heat consumption of the fixing belt 21 from the heating position to the nip position may be reduced and the energy saving may be improved. In addition, the accuracy of the temperature control in the nip portion N may be increased.

As described above, in the fixing device 20 according to the embodiment, the stay 25 is configured to incline at least one of the rise portions 25*b* and 25*c* to the base portion 25*a* such that an inclination direction of the at least one of the rise portions 25*b* and 25*c* is substantially parallel to the virtual straight line L, or falls within a predetermined range of rotational angles by which the virtual straight line L is rotated around the center X of rotation. Accordingly, the mechanical strength of the stay 25 at the time of starting the rotation of the fixing belt 21 may be secured, and the occurrence of bending of the nip formation member 24 by the pressure roller 22 may be prevented. Further, a uniform nip width in the axial direction of the pressure roller 22 may be secured, and a reproduced image with good quality may be obtained.

In the composition of the small-sized fixing belt 21 as in this embodiment, the space for disposing the stay 25 is also small. Hence, the stay 25 is configured to have a section modulus of 200 $mm^3$ or greater. Accordingly, the cross-section of the stay 25 whose cross-sectional area is the same but whose section modulus is large may be selected, the component parts may be efficiently arranged inside the small-sized fixing belt 21, and the mechanical strength of the stay 25 may be secured.

In this embodiment, the nip formation member 24 is formed compactly, and the fixing device is configured so that there is no additional belt guide member that is provided between the fixing belt 21 and the stay 25. An adequate space for arranging the stay 25 inside the fixing belt 21 may be secured. Therefore, in this embodiment, a compact stay 25 with sufficient rigidity may be formed, and the occurrence of bending of the nip formation member 24 by the pressure roller 22 may be prevented.

Figure 11:
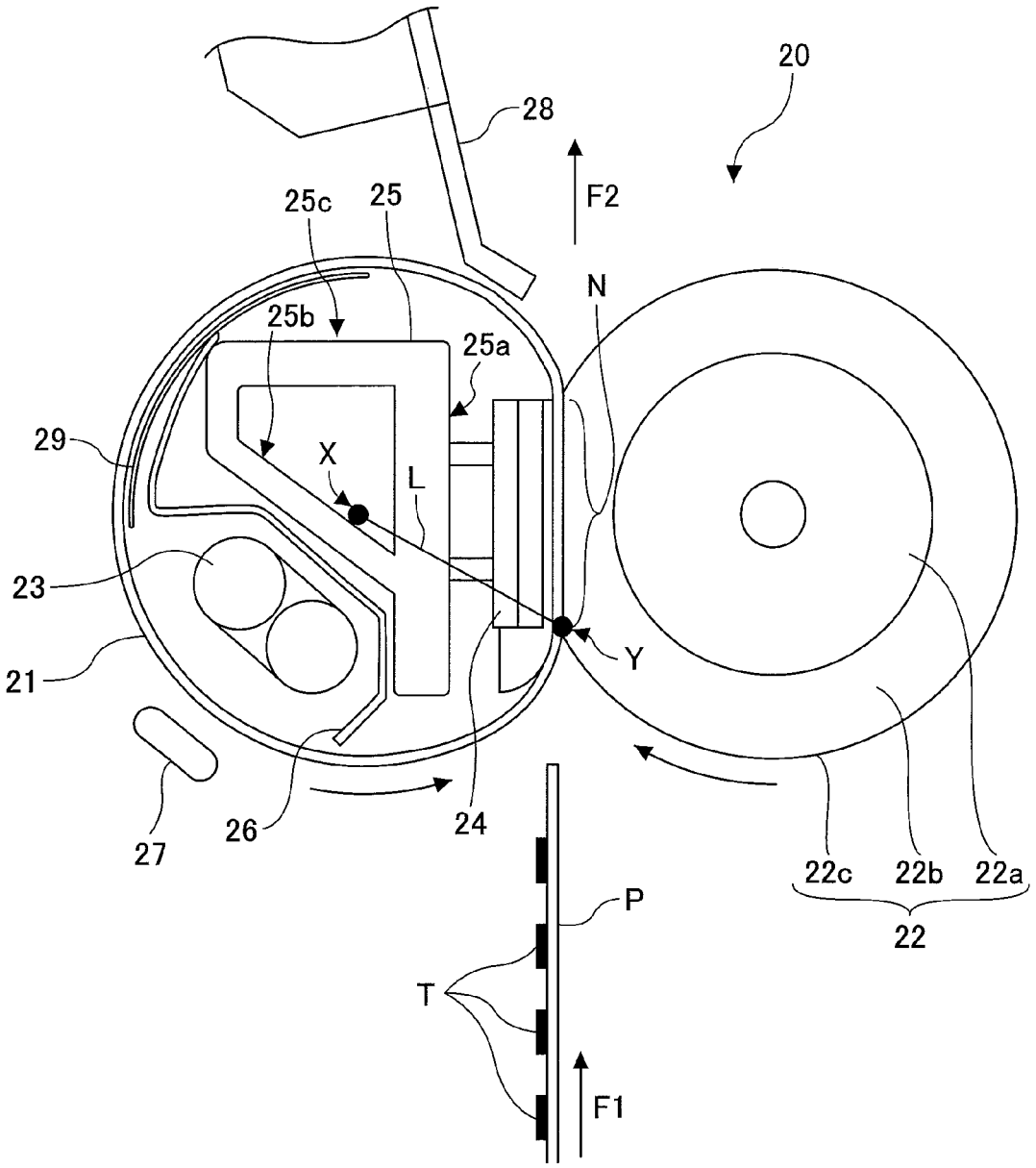
FIG. 11 is a diagram showing a composition of a fixing device including a shield member.

FIG. 11 shows a composition of a fixing device including a shield member. As shown in FIG. 11, the fixing device 20 includes a shield member 29 which is disposed between the halogen heaters 23 in the fixing belt 21 and the fixing belt 21. The shield member 29 is a heating region adjustment member to adjust a heating region of the fixing belt 21 by the halogen heaters 23. By using the shield member 29, the productivity may be maintained even when continuous feeding of sheets whose width is smaller than the heating width of the halogen heaters 23 is performed.

Figure 12:
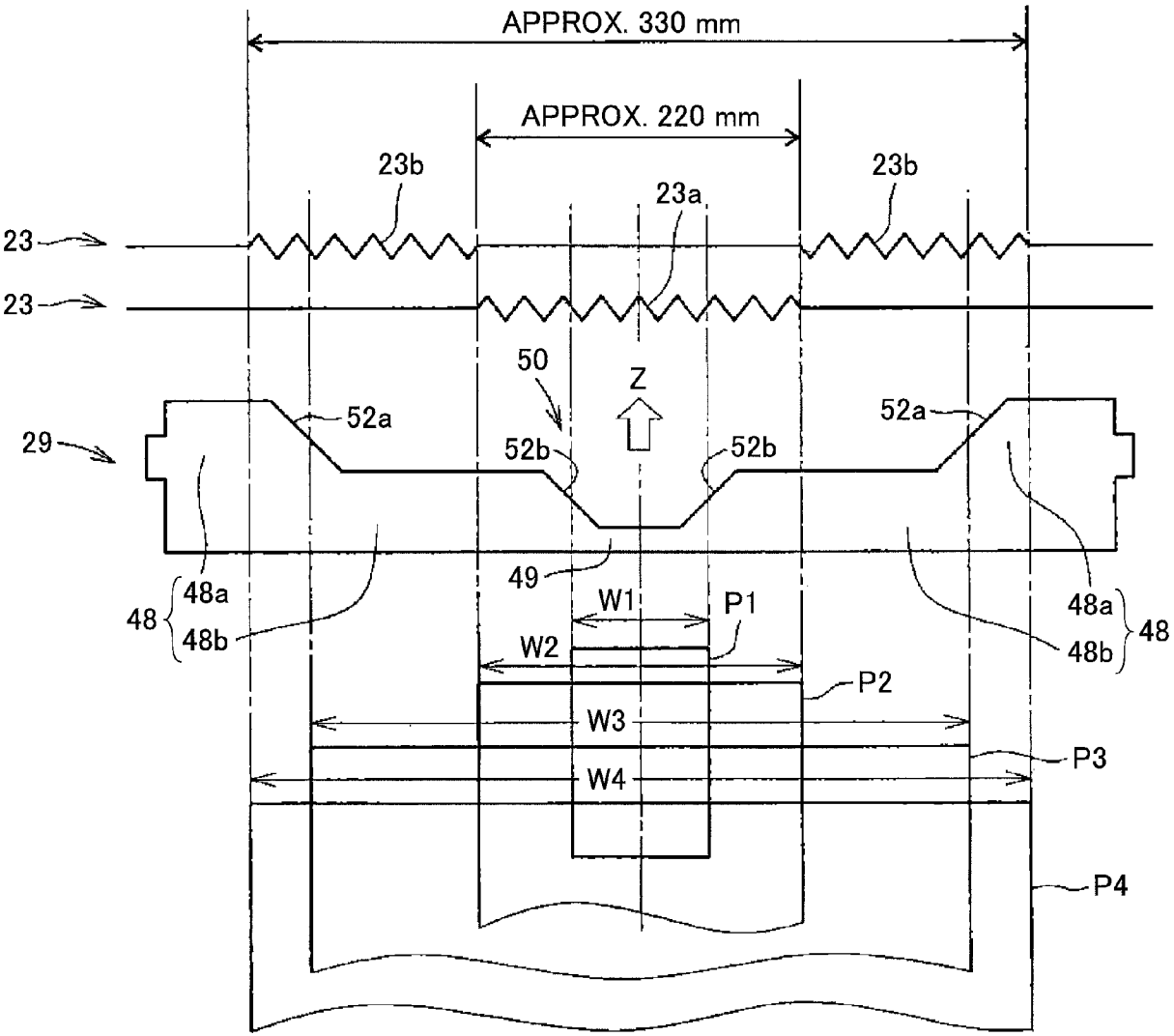
FIG. 12 is a diagram for explaining a relationship between a configuration of the shield member, heating portions of halogen heaters and a sheet size.

FIG. 12 is a diagram for explaining a relationship between a configuration of the shield member 29, heating portions of the halogen heaters 23 and a sheet size.

First, the configuration of the shield member 29 is explained. As shown in FIG. 12, the shield member 29 includes two shield portions 48 provided one at each end of the shield member 29 to shield the fixing belt 21 from the heat of the halogen heaters 23, and a connection portion 49 to connect the two shield portions 48. The shield member 29 further includes an opening 50 between the two shield portions 48 which passes through the heat of the halogen heaters 23 and does not shield the fixing belt 21 from the heat of the halogen heaters 23.

Each of the two shield portions 48 includes two step portions: a small shield portion 48*a* with a small width in the longitudinal direction thereof, and a large shield portion 48*b* with a large width in the longitudinal direction thereof. The large shield portions 48*b* of the two shield portions 48 are connected via the connection portion 49. If it is assumed that a surface of the shield member 29 facing the halogen heaters 23 is a shield side Z, the small shield portion 48*a* is formed to be continuous to the shield side Z of the large shield portion 48*b*.

Two opposed inside walls of the small shield portions 48*a* and two opposed inside walls of the large shield portions 48*b* are formed into slanting portions 52*a* and slanting portions 52*b*, respectively. The slanting portions 52*a* and 52*b* are inclined to the small and large shield portions 48*a* and 48*b* such that respective distances between the slanting portions 52*a* and 52*b* are broadened in the direction indicated by the arrow in FIG. 12.

It is preferred that the shield member 29 is implemented by a metallic material with high heat resistance, such as aluminum, iron, stainless steel, etc.

Next, the relationship between the heating portion of the halogen heaters and the sheet size is explained. In FIG. 12, at least four kinds of sheets: a small size sheet P1, a middle size sheet P2, a large size sheet P3, and a very large size sheet P4 are utilized in the fixing device according to this embodiment. For example, the small size sheet P1 has a width of 100 mm, the middle size sheet P2 has a width of 220 mm, the large size sheet P3 has a width of 297 mm, and the very large size sheet P4 has a width of 330 mm. However, the present disclosure is not limited to the example of sheet size in this embodiment.

As shown in FIG. 12, in this embodiment, in order to adjust the heating region according to the sheet size, a length and an arrangement position of each of heating portions 23*a* and 23*b* of the halogen heaters 23 are determined. The heating portion 23*a* is arranged in the middle of one of the halogen heaters 23 in the longitudinal direction thereof, and the heating portions 23*b* are arranged at both end portions of the other halogen heater 23 in the longitudinal direction thereof.

In the example shown in FIG. 12, the length of the heating portion 23*a* in the middle of the halogen heater 23 is equivalent to the width W2 of the middle size sheet P2, and the heating portions 23*b* at both the end portions of the other halogen heater 23 are arranged so that the length between the heating portions 23*b* is greater than the width W2 of the middle size sheet P2 and the width W3 of the large size sheet P3 and equivalent to the width W4 of the very large size sheet P4.

The slanting portions 52*a* and the slanting portions 52*b* are formed in the small shield portion 48*a* and the large shield portion 48*b*, respectively. By changing the rotational position of the shield member 29 relative to the halogen heaters 23, the range to cover the heating portions 23*a* and 23*b* by the slanting portions 52*a* and 52*b* may be adjusted.

Figure 13:
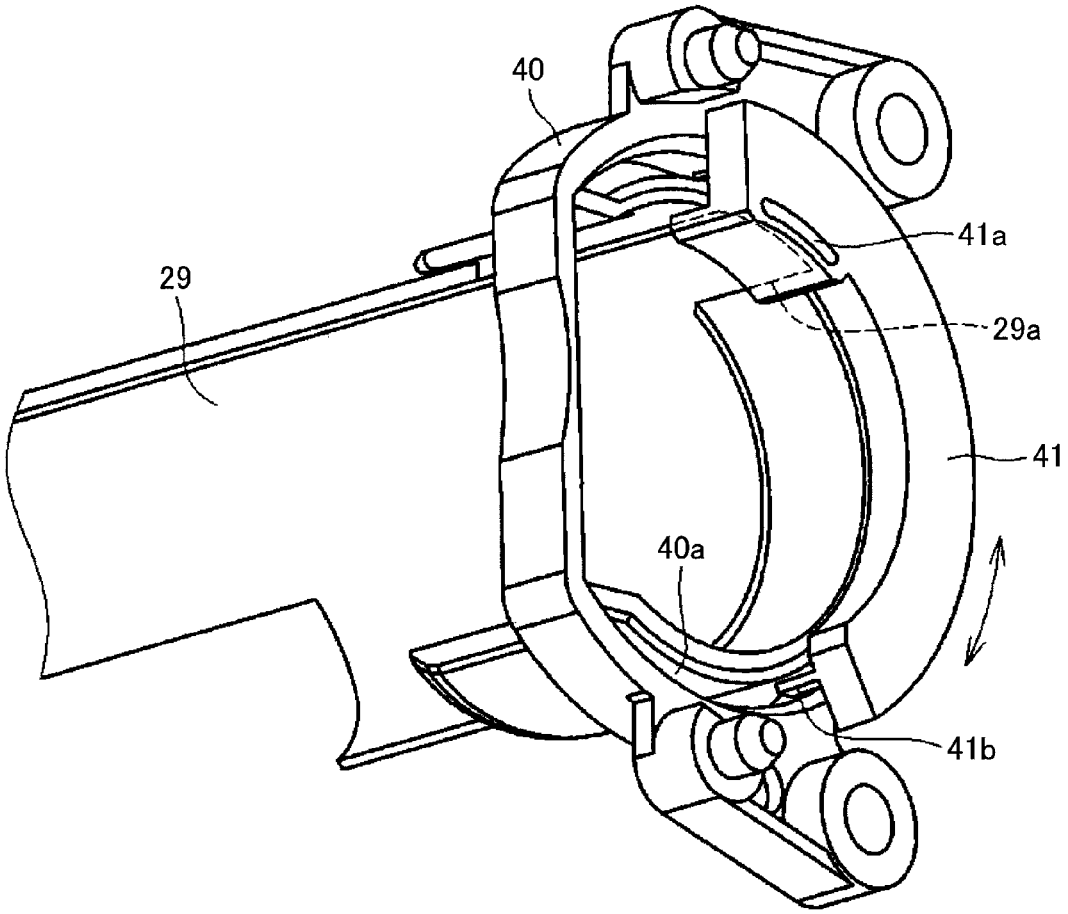
FIG. 13 is a diagram showing a composition of a slide member at an end portion of the shield member.

FIG. 13 is a diagram showing a composition of a slide member 41 at an end portion of the shield member 29. As shown in FIG. 13, the shield member 29 is supported by an arc-shaped slide member 41 attached to the flange 40. Specifically, a projection 29*a* provided at the end portion of the shield member 29 is inserted in a hole portion 41*a* provided in the slide member 41 so that the shield member 29 is attached to the slide member 41. A convex portion 41*b* is formed in the slide member 41 and the convex portion 41*b* is inserted in a circular groove 40*a* provided in the flange 40, so that the slide member 41 is slidable on the flange 40 along the groove 40*a*. Hence, rotational movement of the shield member 29, attached to the slide member 41, in the circumferential direction of the flange 40 is enabled. In this embodiment, the flange 40 and the slide member 41 are implemented by a resin material.

In FIG. 13, only the composition of the slide member 41 at one end portion of the shield member 29 is illustrated. Similarly, the slide member 41 at the other end portion of the shield member 29 has the same composition as illustrated in FIG. 13.

Figure 14:
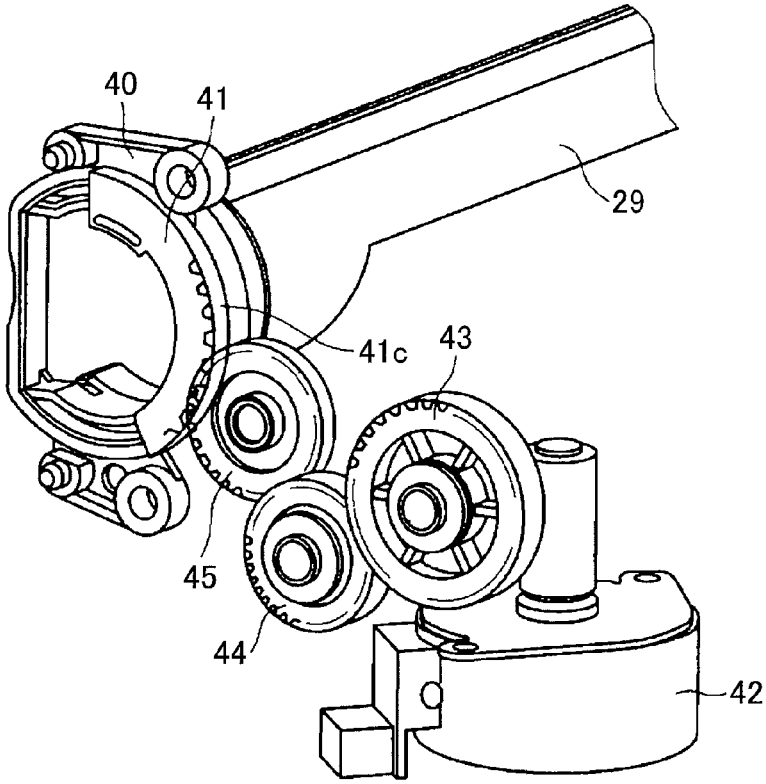
FIG. 14 is a diagram showing a composition of a drive mechanism of the shield member.

FIG. 14 is a diagram showing a composition of a drive mechanism of the shield member 29. As shown in FIG. 14, the drive mechanism of the shield member 29 in this embodiment includes a motor 42 as a drive source, and a gear train including gears 43, 44 and 45. The gear 43 at one end of the gear train is engaged with the motor 42, and the gear 45 at the other end of the gear train is engaged with a gear portion 41*c* provided on the periphery of the slide member 41. In the gear train, the gear 43 is engaged with the gear 45 through the gear 44. Hence, upon a start of the motor 42 operation, the drive force is transmitted to the slide member 41 through the gear train, and rotational movement of the shield member 29 attached to the slide member 41 is performed.

Figure 15:
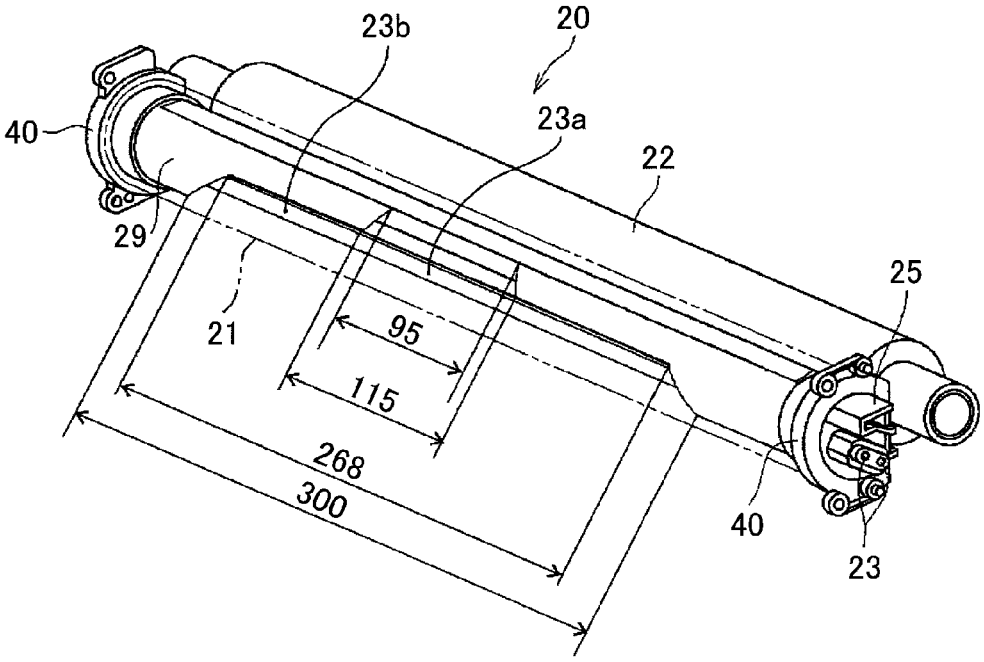
FIG. 15 is a perspective view of the fixing device in a state in which the shield member is exposed.
Figure 16:
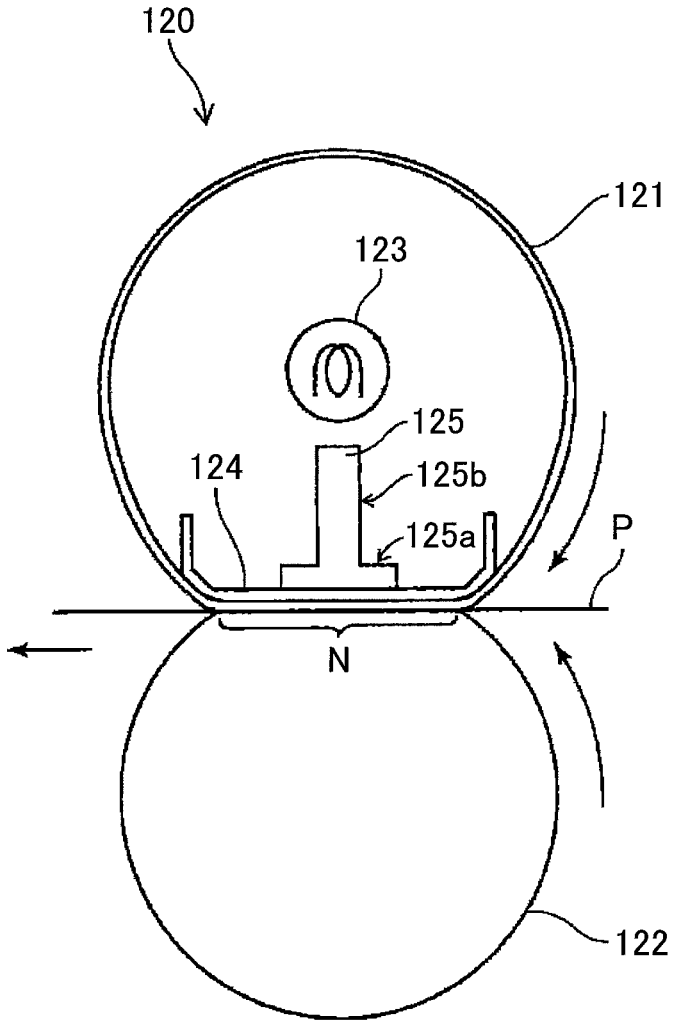
FIG.16 RELATED ART
FIG. 16 is a diagram showing a composition of a fixing device according to the related art.

FIG. 15 is a perspective view of the fixing device 20 in a state in which the shield member 29 is exposed by eliminating the fixing belt 21. As shown in FIG. 15, the shield member 29 is configured to have a peripheral-direction shield length that is varied according to a position in the axial direction. Hence, the region of the halogen heaters 23 shielded by the shield member 29 is adjusted according to the rotational angle of the shield member 29 when the rotational movement of the shield member 29 is performed by the drive mechanism shown in FIG. 14. Thereby, the heating width of the fixing belt 21 by the halogen heaters 23 may be changed by changing the rotation angle of the shield member 29 according to the size of the sheet being fed.

In the example shown in FIG. 15, the width W1 of the small size sheet P1 is smaller than the length of the heating portion 23*a* in the middle of the halogen heaters 23. In relation to the configuration of the shield member 29, the slanting portions 52*b* of the large shield portions 48*b* are disposed to cover the width W1 of the small size sheet P1, and the slanting portions 52*a* of the small shield portions 48*a* are disposed to cover the width W3 of the large size sheet P3.

When a small size sheet P1 is fed, only the heating portion 23*a* in the middle of the halogen heater 23 is activated to generate heat. In this case, however, the heating region of the fixing belt 21 heated by the heating portion 23*a* in the middle of the halogen heater 23 exceeds the width W1 of the small size sheet P1. To avoid this, the shield member 29 is rotated to a predetermined shield position. Thereby, the outer portions of the halogen heater 23 extending outward from both the ends of the small size sheet P1 are shielded by the large shield portions 48*b* of the shield member 29, and the temperature rise of the non-sheet-feeding region of the fixing belt 21 may be suppressed.

When a middle size sheet P2 is fed, the rotational movement of the shield member 29 is performed to adjust the rotational angle of the shield member 29 so that the fixing belt 21 may be heated by only the heating portion 23*a* of the halogen heater 23, whose length is equivalent to the width W2 of the middle size sheet P2 width of sheet W2. Thereby, the temperature rise of the non-sheet-feeding region of the fixing belt 21 may be suppressed.

When a very large size sheet P4 is fed, the rotational movement of the shield member 29 is performed to adjust the rotational angle of the shield member 29 so that the fixing belt 21 may be heated by the heating portions 23*b* at the end portions of the halogen heater 23 in addition to the heating portion 23*a*, the heating range of the halogen heaters 23 corresponding to the width W4 of the very large size sheet P4.

In this embodiment, the heating range of the halogen heaters 23 corresponds to only the width W2 of the middle size sheet P2 and the width W4 of the very large size sheet P4, and does not correspond to the width W3 of the large size sheet P3. For this reason, in a case where a large size sheet P3 is fed, the necessary heating range of the halogen heater 23 is not obtained if only the heating portion 23*a* in the middle of the halogen heater 23 is activated to generate heat, and if all the heating portions 23*a* and 23*b* of the halogen heaters 23 are activated to generate heat, the heating range of the halogen heater 23 exceeds the width W3 of the large size sheet P3.

If the large size sheet P3 is fed in the state where all the heating portions 23*a* and 23*b* of the halogen heaters 23 are activated to generate heat, the temperature of the fixing belt 21 in the non-sheet-feeding region extending outward from the ends of the large size sheet P3 may increase excessively.

To eliminate the problem, in this embodiment, when a large size sheet P3 is fed, the shield member 29 is rotated to a predetermined shield position, and the outer portions of the halogen heaters 23 extending outward from both the ends of the large size sheet P3 are shielded by the small shield portions 48*a* of the shield member 29. Thereby, the temperature rise of the non-sheet-feeding region of the fixing belt 21 may be suppressed. Accordingly, the productivity may be maintained even when continuous feeding of sheets whose width is smaller than the heating width of the heating portions 23*b* of the halogen heater 23 is performed.

In this embodiment, a standby position (a starting point of the rotational movement) of the shield member 29 where a maximum heating region of the fixing belt by the halogen heaters 23 is reached is located upstream of the halogen heaters 23 in the rotational direction of the fixing belt. The rotation angle of the shield member 29 in this embodiment may be made larger than in a case where the standby position of the shield member 29 is located downstream of the halogen heaters 23 in the rotational direction of the fixing belt. Thereby, the heating range of the halogen heaters 23 may be set up with good accuracy. As a result, the productivity is maintained with the fixing device 20 according to the embodiment.

As described above, in the fixing device according to the present invention, the occurrence of bending or torsion of a nip formation member at a start of rotation of the fixing belt may be prevented.

The fixing device according to the invention is not limited to the above-described embodiments, and variations and modifications may be made without departing from the scope of the present invention. The fixing device according to the present invention is applicable to not only the color laser printer shown in FIG. 2, but also monochrome image forming apparatuses, other printers, copiers, facsimile machines, multi-function peripherals, etc.

What is claimed is:

1. A fixing device comprising:

a rotatably supported endless fixing belt;

a pressure roller disposed to press an outer peripheral surface of the fixing belt and cause rotation of the fixing belt when the pressure roller is rotated;

a nip formation member disposed on an inner peripheral surface of the fixing belt to form a nip portion in the fixing belt between the nip formation member and the pressure roller when the fixing belt is pressed by the pressure roller;

a heating unit to heat the fixing belt; and a support member disposed to support the nip formation member on the inner peripheral surface of the fixing belt, wherein the support member comprises a parallel portion that supports the nip formation member and extends parallel to a sheet transport direction in the nip portion, and a rise portion that extends from the parallel portion in a direction drawn apart from the nip portion, and the rise portion is inclined to the parallel portion such that an inclination direction of the rise portion is substantially parallel to a virtual straight line connecting a center of rotation of the fixing belt and an inlet point of the nip portion or falls within a range of rotational angles of ±15 by which the virtual straight line is rotated around the center of rotation of the fixing belt.

2. The fixing device according to claim 1, wherein the support member is configured to have a section modulus of 200 $mm^3$ or greater.

3. The fixing device according to claim 1, wherein the support member is configured to have a closed cross-section that is perpendicular to an axial direction of the fixing belt.

4. The fixing device according to claim 1, wherein the heating unit is disposed at a downstream position of the rise portion in a rotational direction of the fixing belt on an inner peripheral side of the fixing belt.

5. The fixing device according to claim 4, further comprising a heating region adjustment member disposed on the inner peripheral side of the fixing belt to be movable along the rotational direction of the fixing belt, the heating region adjustment member adjusting a heating region of the fixing belt by shielding the fixing belt from heat of the heating unit, wherein a standby position of the heating region adjustment member where a maximum heating region of the fixing belt by the heating unit is reached is located upstream of the heating unit in the rotational direction of the fixing belt and downstream of the nip portion in the rotational direction of the fixing belt.

6. The fixing device according to claim 4, wherein the support member further comprises a reflection surface to reflect light emitted from the heating unit.

7. The fixing device according to claim 6, wherein the reflection surface of the support member has a reflection factor of 90% or greater.

8. The fixing device according to claim 6, wherein the reflection surface is arranged such that the light emitted from the heating unit is reflected to the fixing belt by a part or all of the reflection surface in directions toward portions of the fixing device other than the heating unit.

9. An image forming apparatus comprising:

an image support;

a toner image formation unit to form a toner image on the image support;

a transfer unit to transfer the toner image from the image support to a recording medium; and the fixing device according to claim 1, wherein the fixing device serves as a fixing unit to fix the toner image transferred to the recording medium by the transfer unit onto the recording medium.

10. A fixing device comprising:

a rotatably supported endless fixing belt;

a pressure roller disposed to press an outer peripheral surface of the fixing belt and cause rotation of the fixing belt when the pressure roller is rotated;

a nip formation member disposed on an inner peripheral surface of the fixing belt to form a nip portion in the fixing belt between the nip formation member and the pressure roller when the fixing belt is pressed by the pressure roller;

a support member disposed to support the nip formation member on the inner peripheral surface of the fixing belt;

a heating unit to heat the fixing belt; and a heating region adjustment member disposed on an inner peripheral side of the fixing belt to be movable along a rotational direction of the fixing belt, the heating region adjustment member adjusting a heating region of the fixing belt by shielding the fixing belt from heat of the heating unit, wherein a standby position of the heating region adjustment member where a maximum heating region of the fixing belt by the heating unit is reached is located upstream of the heating unit in the rotational direction of the fixing belt and downstream of the nip portion in the rotational direction of the fixing belt, the support member is configured to have a closed cross-section that is perpendicular to anaxial direction of the fixing belt, and the support member comprises a parallel portion that supports the nip formation member and extends parallel to a sheet transport direction in the nip portion, and a rise portion that extends at a position upstream of the nip portion in the rotational direction of the fixing belt from the parallel portion in a direction drawn apart from the nip portion, and the rise portion is inclined to the parallel portion so that a space for arranging the heating unit between the fixing belt and the rise portion is provided at a location downstream of the standby position of the heating region adjustment member in the rotational direction of the fixing belt and upstream of the nip portion in the rotational direction of the fixing belt.

* * * * *